US009785124B2

(12) United States Patent
Mitani et al.

(10) Patent No.: US 9,785,124 B2
(45) Date of Patent: Oct. 10, 2017

(54) ELECTRONIC TIMEPIECE WITH INTERNAL ANTENNA

(71) Applicant: Seiko Epson Corporation, Tokyo (JP)

(72) Inventors: Toshihiro Mitani, Matsumoto (JP); Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/030,198

(22) Filed: Sep. 18, 2013

(65) Prior Publication Data

US 2014/0086026 A1 Mar. 27, 2014

(30) Foreign Application Priority Data

Sep. 24, 2012 (JP) ..... 2012-209023
Sep. 24, 2012 (JP) ..... 2012-209026
Sep. 24, 2012 (JP) ..... 2012-209027

(51) Int. Cl.

| | |
|---|---|
| ***G04R 60/00*** | (2013.01) |
| ***G04R 60/02*** | (2013.01) |
| ***G04R 60/04*** | (2013.01) |
| ***G04R 60/06*** | (2013.01) |
| ***G04R 60/08*** | (2013.01) |
| ***G04R 60/10*** | (2013.01) |
| ***G04R 60/12*** | (2013.01) |
| ***G04G 17/00*** | (2013.01) |
| ***G04R 20/04*** | (2013.01) |

(52) U.S. Cl.

CPC ..... *G04R 60/10* (2013.01); *G04G 17/00* (2013.01); *G04R 20/04* (2013.01); *G04R 60/00* (2013.01); *G04R 60/02* (2013.01); *G04R 60/08* (2013.01); *G04R 60/12* (2013.01)

(58) Field of Classification Search

CPC ..... G04R 17/00; G04R 60/00; G04R 60/02; G04R 60/06; G04R 60/08; G04R 60/10; G04R 60/12; G04G 17/00

USPC ..... 368/47, 276, 286, 293; 342/357.39, 342/357.48

See application file for complete search history.

(56) References Cited

U.S. PATENT DOCUMENTS 5,627,552 A * 5/1997 Farrar ..... G04G 21/04 343/718
5,699,319 A * 12/1997 Skrivervik ..... 368/10
2005/0018543 A1* 1/2005 Fujisawa ..... 368/47
2006/0220957 A1 10/2006 Tanaka et al.
2008/0080320 A1* 4/2008 Abe et al. ..... 368/47
2008/0094942 A1* 4/2008 Oguchi et al. ..... 368/47
(Continued)

FOREIGN PATENT DOCUMENTS

CA 2231103 A1 * 10/1998 ..... G04B 47/00
JP 2003-294868 A 10/2003
(Continued)

*Primary Examiner* — Amy Cohen Johnson
*Assistant Examiner* — Daniel Wicklund
(74) *Attorney, Agent, or Firm* — Harness, Dickey & Pierce, P.L.C.

(57) ABSTRACT

An electronic timepiece has a case; an annular antenna housed in the case; a time display unit that is disposed on the inside of the antenna, and includes a dial and hands that rotate on a center pivot; and a battery compartment housing a storage battery that feeds the antenna. The antenna is not superimposed with the storage battery held in the battery compartment when seen from the direction perpendicular to the dial.

19 Claims, 22 Drawing Sheets

(56) References Cited

U.S. PATENT DOCUMENTS

| | | | | |
|---|---|---|---|---|
| 2009/0201769 | A1* | 8/2009 | Miyahara | 368/10 |
| 2009/0251997 | A1* | 10/2009 | Kimura | 368/47 |
| 2010/0097895 | A1* | 4/2010 | Sumida et al. | 368/28 |
| 2011/0013491 | A1* | 1/2011 | Fujisawa | 368/10 |
| 2011/0051561 | A1* | 3/2011 | Fujisawa | 368/47 |
| 2012/0120772 | A1* | 5/2012 | Fujisawa | G04C 10/02 368/64 |
| 2012/0170423 | A1* | 7/2012 | Fujisawa | 368/10 |
| 2014/0086020 | A1* | 3/2014 | Fujisawa | G04R 60/12 368/47 |
| 2015/0016229 | A1* | 1/2015 | Yanagisawa | G04R 60/12 368/47 |

FOREIGN PATENT DOCUMENTS

| | | | |
|---|---|---|---|
| JP | 2006-287369 | A | 10/2006 |
| JP | 2007-232680 | A | 9/2007 |
| JP | 2008-306466 | A | 12/2008 |
| JP | 2011-021929 | A | 2/2011 |
| JP | 2011-208944 | A | 10/2011 |
| JP | 2012-075090 | A | 4/2012 |
| JP | 2012-075091 | A | 4/2012 |
| JP | 2012-163516 | A | 8/2012 |
| JP | 2013050336 | A | 3/2013 |

* cited by examiner

ELECTRONIC TIMEPIECE WITH INTERNAL ANTENNA

BACKGROUND

1. Technical Field

The present invention relates to an electronic timepiece with an internal antenna.

2. Related Art

Electronic timepieces that receive signals from positioning information satellites such as GPS (Global Positioning System) satellites to display accurate time are known from the literature. Such electronic timepieces have an antenna and a storage battery that feeds the antenna. See, for example, Japanese Unexamined Patent Appl. Pub. JP-A-2011-21929.

When the storage battery is located close to the antenna in an electronic timepiece that has an internal antenna and a storage battery that feeds the antenna, the storage battery may interfere with signals from a positioning information satellite and reduce the strength of the signal received by the antenna. Maintaining good signal reception performance by the antenna can therefore be difficult.

Analog electronic timepieces that have a stepper motor usually have a magnetic screen that magnetically shields the stepper motor to prevent the stepper motor from operating incorrectly due to magnetic field effects. The magnetic screen may also absorb electromagnetic waves, including the radio waves from positioning information satellites. As a result, the radio waves from the positioning information satellite that should be received by the antenna will be absorbed by the magnetic screen if the magnetic screen is close to the antenna, and maintaining good signal reception performance in the antenna can be difficult.

If the electronic timepiece has a ring-shaped (loop) antenna, the gain of the loop antenna will be greatest in the direction from the center of the antenna to where the feed part that receives power from the feed pin is located. Therefore, if a magnetic screen that absorbs signals from a positioning information satellite is disposed close to the feed pin, signals from the positioning information satellite will be absorbed by the magnetic screen in the direction where antenna gain is greatest, and maintaining good signal reception performance in the antenna is difficult.

SUMMARY

The invention maintains good reception performance by the antenna in an electronic timepiece with an internal antenna.

One aspect of the invention is an electronic timepiece with internal antenna, including: a case; an annular antenna housed in the case; a time display unit that can display time and is disposed on the inside of the antenna; a drive unit that is housed in the case and drives the time display unit; and a magnetic screen that is disposed superimposed with part or all of the drive unit in plan view; wherein all or part of the antenna is not superimposed with the magnetic screen in plan view.

The reception performance of the antenna drops when a magnetic screen is disposed near the antenna because the radio waves to be received by the antenna are blocked by the magnetic screen.

The invention disposes the magnetic screen to a position not superimposed with part or all of the antenna in plan view, and can therefore increase the distance between the antenna and the magnetic screen compared with a configuration in which all of the antenna is disposed to a position superimposed with the magnetic screen in plan view. As a result, good antenna reception performance can be assured.

Note that herein "inside the antenna" means the direction toward the center axis of the antenna ring, and is the area enclosed by the antenna loop in plan view.

Plan view as used herein refers to viewing the electronic timepiece with internal antenna from the direction aligned with the center axis of the antenna loop.

An electronic timepiece with internal antenna according to another aspect of the invention has a case; an annular antenna housed in the case; a time display unit that can display time and is disposed on the inside of the antenna; a main plate housed in the case; a drive unit that is housed in the case on the opposite side of the main plate as the antenna, and drives the time display unit; and a first magnetic screen that is disposed between the drive unit and the main plate, and superimposed with part or all of the drive unit in plan view; wherein the antenna is not superimposed with the first magnetic screen in plan view.

The reception performance of the antenna drops when a magnetic screen is disposed near the antenna because the radio waves to be received by the antenna are blocked by the magnetic screen. Because a magnetic screen is provided to shield the drive unit from magnetic fields produced outside the drive unit, a magnetic screen is often provided on both sides of the drive unit, that is, on the main plate side of the drive unit and the opposite side of the drive unit. Compared with the magnetic screen disposed on the opposite side of the drive unit as the main plate, the magnetic screen disposed on the main plate side of the drive unit is closer to the antenna. The magnetic screen disposed on the main plate side of the drive unit therefore has a greater effect on the reception performance of the antenna than the magnetic screen disposed on the opposite side of the drive unit as the main plate.

The invention disposes the antenna to a position not superimposed with the first magnetic screen, which is the magnetic screen on the main plate side of the drive unit, when seen in plan view. The distance to the first magnetic screen, which has the greater effect on the reception performance of the antenna, can therefore be increased compared with a configuration in which the antenna and first magnetic screen are disposed to superimposed positions in plan view. Good reception performance can therefore be maintained in the antenna of the electronic timepiece with internal antenna.

An electronic timepiece with internal antenna according to another aspect of the invention also has a second magnetic screen that is disposed on the opposite side of the main plate as the drive unit, and superimposed with part or all of the drive unit in plan view; and the antenna is not superimposed with the second magnetic screen in plan view.

Because the antenna is disposed to a position not superimposed with the second magnetic screen in this aspect of the invention, the distance between the antenna and second magnetic screen can be increased compared with a configuration in which the antenna and second magnetic screen are disposed to superimposed positions in plan view. Good reception performance can therefore be assured in the antenna of the electronic timepiece with internal antenna.

An electronic timepiece with internal antenna according to another aspect of the invention also has a crystal that covers one of two openings in the case, and protects the time display unit; and a back cover that covers the other of the two case openings; wherein the time display unit includes a dial disposed between the crystal and the main plate, and the distance between the back cover and the dial is greater than the distance between the back cover and the antenna.

An antenna can generally achieve good reception performance when the section area of the antenna is large. Because the antenna is recessed deeply to the back cover side from the dial in this aspect of the invention, the thickness of the antenna in the face-back direction can be increased compared with when a thin antenna is disposed on the crystal side of the dial. The section area of the antenna can therefore be increased, and good antenna reception performance can be assured.

In an electronic timepiece with internal antenna according to another aspect of the invention, the antenna has a slope that is on the inside circumference of the antenna and increases in distance from the back cover with proximity to the center of the antenna; and the dial is superimposed with at least part of the slope in plan view.

By disposing the dial superimposed with part of the antenna, this aspect of the invention can increase the size of the dial compared with a configuration in which the dial is not superimposed with the antenna. The dial is thus easier to read by the user of the electronic timepiece with internal antenna.

An electronic timepiece with internal antenna according to another aspect of the invention, preferably also has a ground for the antenna between the antenna and the main plate; the case has a body that is made of a conductive material and is electrically connected to the ground; and the back cover is made of a conductive material and is electrically connected to the case.

In this aspect of the invention the ground, case body, and back cover function as the ground plane of the antenna. Because the case body and back cover in an electronic timepiece with internal antenna have a large volume and area, the ground potential of the antenna can be stabilized compared with a configuration that does not have a case body and back cover, and only the ground functions as the ground plane of the antenna. Good antenna reception performance can therefore be assured for the antenna of an electronic timepiece with internal antenna according to this aspect of the invention.

An electronic timepiece with internal antenna according to another aspect of the invention preferably also has a battery compartment that holds a storage battery that feeds the antenna; and the antenna is not superimposed with the battery compartment in plan view.

The reception performance of the antenna drops when the antenna is near the storage battery because the storage battery blocks radio waves that should be received by the antenna. Because this aspect of the invention disposes the antenna to a position not superimposed with the storage battery in plan view, the distance between the antenna and the storage battery can be increased compared with a configuration in which the antenna and storage battery are superimposed in plan view. Good antenna reception performance can therefore be assured for the antenna of an electronic timepiece with internal antenna according to this aspect of the invention.

An electronic timepiece with internal antenna according to another aspect of the invention has a case; an annular antenna housed in the case; and a battery compartment that holds a storage battery that feeds the antenna; and the antenna is not superimposed with the storage battery held in the battery compartment when seen in plan view.

When the storage battery is near the antenna, the reception performance of the antenna may drop. Because this aspect of the invention disposes the antenna to a position not superimposed with the storage battery in plan view, the distance between the antenna and the storage battery can be increased compared with a configuration in which the antenna and storage battery overlap. Good antenna reception performance can therefore be assured in an electronic timepiece with internal antenna according to this aspect of the invention.

An electronic timepiece with internal antenna according to another aspect of the invention has a case; an annular antenna housed in the case; a time display unit that is disposed on the inside of the antenna, and includes a dial and a hand that can rotate on a center pivot; and a battery compartment that holds a storage battery that feeds the antenna; wherein the antenna is not superimposed with the storage battery held in the battery compartment when seen from the direction perpendicular to the dial.

Because this aspect of the invention disposes the antenna to a position not superimposed with the storage battery in plan view, the distance between the antenna and the storage battery can be increased compared with a configuration in which the antenna and storage battery overlap. Good antenna reception performance can therefore be assured in an electronic timepiece with internal antenna according to this aspect of the invention.

An electronic timepiece with internal antenna according to another aspect of the invention preferably also has a drive unit that is housed in the case and drives the time display unit; a circuit board that is housed in the case and has a control unit that controls operation of the drive unit; a feed pin that electrically connects the circuit board and a feed part of the antenna; and an operating unit including a crown of which at least part is on the outside of the case, and a stem that transfers movement of the crown to the drive unit; wherein the feed pin is not superimposed with the operating unit when seen from the direction perpendicular to the dial.

Further preferably, the battery compartment is disposed on the opposite side of the circuit board as the feed pin.

Because the circuit board is between the feed pin and storage battery in this aspect of the invention, the effect of the storage battery on the reception performance of the antenna through the feed pin can be reduced compared with a configuration in which the circuit board is not between the feed pin and storage battery, and good antenna reception performance can be assured.

Further preferably in an electronic timepiece with internal antenna according to another aspect of the invention, the stem is disposed in the direction of 3:00 on the dial from the center pivot, and the feed pin is disposed in the range from 6:00 to 12:00 on the dial from the center pivot, when seen from the direction perpendicular to the dial.

More specifically, when the electronic timepiece with internal antenna is viewed from the direction perpendicular to the dial, the stem is disposed to intersect a ray starting at the center pivot and passing through the 3:00 of the dial, and the feed pin is disposed on a line passing between the center pivot and the 6:00 position of the dial or the 9:00 side of this line.

Further preferably in an electronic timepiece with internal antenna according to another aspect of the invention, the operating unit includes a pusher of which at least part is on the outside of the case, and a button stem that transfers movement of the pusher to the drive unit or the control unit; and the button stem is disposed from 1:00 to 5:00 on the dial from the center pivot when seen from the direction perpendicular to the dial.

Further preferably in an electronic timepiece with internal antenna according to another aspect of the invention, the control unit is not superimposed with the battery compartment when seen from the direction perpendicular to the dial.

Another aspect of the invention is an electronic timepiece with internal antenna, having: a case; an annular antenna housed in the case; a time display unit that is disposed on the inside of the antenna, and includes a dial and a hand that can rotate on a pivot; a circuit board that is housed in the case; a drive unit that drives the time display unit and is disposed between the circuit board and the dial when seen from the direction parallel to the dial; a feed pin that electrically connects the circuit board and a feed part of the antenna; and a magnetic screen disposed at least between the drive unit and the dial, or between the drive unit and the circuit board; and the feed pin is not superimposed with the magnetic screen when seen from the direction perpendicular to the dial.

The reception performance of the antenna drops when a magnetic screen is near the feed pin that supplies potential to the antenna. Because this aspect of the invention disposes the feed pin to a position not superimposed with the magnetic screen in plan view, the distance between the feedpin and the magnetic screen can be increased compared with a configuration in which the feed pin and the magnetic screen are superimposed in plan view. Good antenna reception performance can therefore be assured in an electronic timepiece with internal antenna according to this aspect of the invention.

Further preferably, the magnetic screen includes a first magnetic screen disposed between the drive unit and the dial, and a second magnetic screen disposed between the drive unit and the circuit board; and the feed pin is not superimposed with the first magnetic screen and second magnetic screen when seen from the direction perpendicular to the dial.

Yet further preferably in an electronic timepiece with internal antenna according to another aspect of the invention, the antenna and magnetic screen are not superimposed when seen from the direction perpendicular to the dial.

The reception performance of the antenna can drop when a magnetic screen is near the antenna. Because this aspect of the invention disposes the antenna to a position not superimposed with the magnetic screen in plan view, the distance between the antenna and the magnetic screen can be increased compared with a configuration in which the antenna and the magnetic screen are superimposed in plan view. Good antenna reception performance can therefore be assured in an electronic timepiece with internal antenna according to this aspect of the invention.

Yet further preferably in an electronic timepiece with internal antenna according to another aspect of the invention, the distance between the feed pin and the first magnetic screen when seen from the direction perpendicular to the dial, and the distance between the feed pin and the second magnetic screen when seen from the direction perpendicular to the dial, are longer than the length of the feed pin.

Because the distance between the feed pin and the magnetic screens is greater than the length of the feed pin, this aspect of the invention can assure better antenna reception performance than a configuration in which the distance between the feed pin and the magnetic screens is shorter than the length of the feed pin.

Further preferably in an electronic timepiece with internal antenna according to another aspect of the invention, the distance between the feed pin and the first magnetic screen is greater than the distance between the feed pin and the second magnetic screen when seen from the direction perpendicular to the dial.

The antenna is on the dial side of the drive unit. The first magnetic screen disposed to the dial side of the drive unit is therefore closer to the antenna than the second magnetic screen disposed to the circuit board side of the drive unit. The effect of the first magnetic screen on the reception performance of the antenna is therefore greater than the effect of the second magnetic screen on the reception performance of the antenna. Therefore, to minimize the combined effect of the first magnetic screen and second magnetic screen on the reception performance of the antenna, the distance between the first magnetic screen and antenna must be greater than the distance between the second magnetic screen and the antenna in plan view.

In this aspect of the invention, the feed pin is disposed to a position where the distance between the feed pin and the first magnetic screen in plan view is greater than the distance between the feed pin and second magnetic screen in plan view. In a ring-shaped antenna, the part that is fed from the feed pin contributes greatly to the reception performance of the antenna. Therefore, by disposing the feed pin to a position where the distance from the first magnetic screen is increased, the distance between the part of the antenna that contributes greatly to the reception performance of the antenna and the first magnetic screen can be increased. As a result, the combined effect of the first magnetic screen and the second magnetic screen on the reception performance of the antenna can be reduced.

Yet further preferably, the electronic timepiece with internal antenna according to another aspect of the invention has a battery compartment that holds a storage battery that feeds the antenna; and the distance between the storage battery in the battery compartment and the feed pin when seen from the direction perpendicular to the dial is greater than the length of the feed pin.

The reception performance of the antenna can drop when the storage battery is near the feed pin that feeds potential to the antenna. This aspect of the invention makes the distance between the feed pin and the storage battery greater than the length of the feed pin, and can therefore achieve better antenna reception performance than when the distance between the feed pin and the storage battery is shorter than the length of the feed pin.

In an electronic timepiece according to another aspect of the invention, the batter compartment is preferably on the opposite side of the circuit board as the feed pin.

Because the circuit board is between the feed pin and storage battery in this aspect of the invention, the effect of the storage battery on the reception performance of the antenna through the feed can be reduced compared with a configuration in which a circuit board is not between the feed pin and storage battery, and good antenna reception performance can be assured.

In an electronic timepiece according to another aspect of the invention, the distance between the feed pin and the first magnetic screen is greater than the distance between the feed pin and the storage battery in the battery compartment when seen from the direction perpendicular to the dial.

In an electronic timepiece according to another aspect of the invention, a control unit that controls operation of the drive unit is preferably disposed to the circuit board, and the control unit is not superimposed with the battery compartment when seen from the direction perpendicular to the dial.

An electronic timepiece according to another aspect of the invention preferably also has an operating unit including a crown of which at least part is on the outside of the case, and a stem that transfers movement of the crown to the drive unit; and the feed pin is not superimposed with the operating unit when seen from the direction perpendicular to the dial.

An electronic timepiece according to another aspect of the invention preferably also has an operating unit including a crown of which at least part is on the outside of the case, and a stem that transfers movement of the crown to the drive unit; and the stem is disposed in the direction of 3:00 on the dial from the center pivot, and the feed pin is disposed between 6:00 and 12:00 on the dial from the center pivot, when seen from the direction perpendicular to the dial.

More specifically, when the electronic timepiece with internal antenna is seen perpendicularly to the dial, the stem is disposed where a ray starting from the center pivot passes through the 3:00 position on the dial, and the feed pin is disposed on a line passing through the center pivot and 6:00 on the dial, or a position on the 9:00 side of this line.

In an electronic timepiece according to another aspect of the invention, when seen from the direction perpendicular to the dial, the angle formed by a line segment connecting the pivot and the feed pin, and a line segment connecting the pivot and the center of the storage battery in the battery compartment is greater than or equal to 90 degrees and less than or equal to 180 degrees, and the storage battery in the battery compartment is not superimposed with the operating unit.

Because the feed pin is 90 degrees or more from the storage battery referenced to the center pivot in this aspect of the invention, the distance between the feedpin and the storage battery can be increased compared with a configuration in which the feed pin is at a position less than 90 degrees. The effect of the storage battery on the reception performance of the antenna through the feedpin can therefore be reduced, and good antenna reception performance can be assured in the electronic timepiece with internal antenna according to this aspect of the invention.

Note that the center of the storage battery as used herein may be the geometrical center of gravity of the storage battery. When seen from the direction perpendicular to the dial, the shape of the storage battery could be round or a shape other than round.

Further preferably in an electronic timepiece according to another aspect of the invention, when seen from the direction perpendicular to the dial, the length of a line segment connecting the pivot and the feed pin is less than or equal to the length of a line segment connecting the pivot and the center of the storage battery in the battery compartment, and the storage battery in the battery compartment is not superimposed with the operating unit.

Because the distance between the feed pin and the storage battery is greater than the distance between the feed pin and the center pivot, this aspect of the invention can assure better antenna reception performance than a configuration in which the distance between the feed pin and the storage battery is shorter than the distance between the feed pin and the center pivot.

In an electronic timepiece according to another aspect of the invention, when seen from the direction perpendicular to the dial, the feed pin is disposed in the direction of 9:00 on the dial from the center pivot, and the battery compartment is disposed to a position where the storage battery in the battery compartment is positioned in the direction of 6:00 or 12:00 on the dial from the center pivot.

More specifically, when the electronic timepiece with internal antenna is seen from the direction perpendicular to the dial, the feed pin is disposed where a ray starting at the center pivot passes through the 9:00 position on the dial, and the battery compartment is disposed so that the storage battery in the battery compartment is where a ray starting at the center pivot passes through the 6:00 position on the dial, or where a ray starting at the center pivot passes through the 12:00 position on the dial.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that the size and scale of parts shown in the figures differ from the actual size and scale for convenience. Furthermore, the following examples are specific preferred embodiments of the invention and describe technically desirable limitations, and the scope of the invention is not limited thereby unless such limitation is specifically stated below.

A. Embodiment 1

An electronic timepiece with internal antenna 100 (referred to as electronic timepiece 100 below) according to a first preferred embodiment of the invention is described below with reference to FIG. 1 to FIG. 12.

1. Mechanical Configuration of an Electronic Timepiece with Internal Antenna

Figure 1:
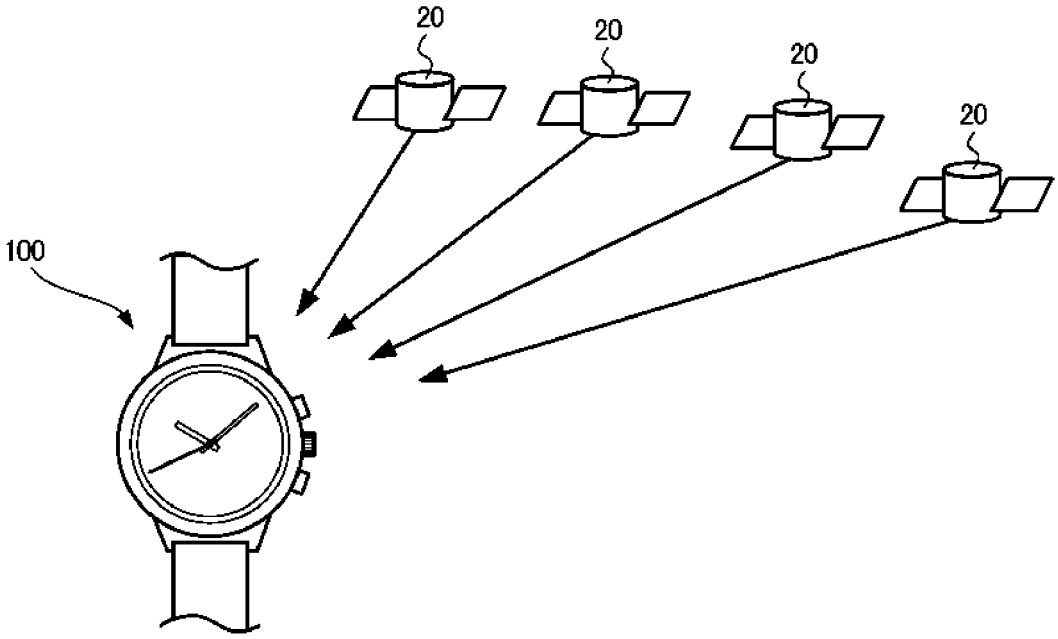
FIG. 1 is an overview of a GPS system including an electronic timepiece 100 with an internal antenna according to a first embodiment of the invention.

FIG. 1 shows the basic concept of a GPS system that includes an electronic timepiece with an internal antenna 100 (referred to as electronic timepiece 100 below) according to a preferred embodiment of the invention.

The electronic timepiece 100 is a wristwatch that receives signals (radio signals) from at least one of plural GPS satellites 20 and adjusts the time based thereon, and displays the time on the surface (side) (referred to below as the "face") on the opposite side as the surface (referred to below as the "back") that contacts the wrist.

A GPS satellite 20 is an example of a positioning information satellite that orbits the Earth on a specific orbit, and transmits a navigation message superimposed on a 1.57542 GHz RF signal (L1 signal). The 1.57542 GHz signal carrying a superimposed navigation message is referred to herein as simply a "satellite signal." These satellite signals are right-handed circularly polarized waves.

The electronic timepiece 100 according to the invention receives signals from GPS satellites 20 in the GPS system, and the GPS system is an example of a satellite positioning system. The invention is not so limited to use with the GPS system, however, and more particularly can be used with other Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The electronic timepiece 100 may therefore be a wristwatch that receives radio waves (radio signals) from positioning information satellites other than GPS satellites 20, and adjusts the internal time based thereon.

There are currently approximately 31 GPS satellites 20 in the constellation. Only 4 of the 31 satellites are shown in FIG. 1.

Each GPS satellite 20 superimposes a unique pattern called a C/A code (Coarse/Acquisition Code), which is a 1023-chip (1 ms) pseudorandom noise code unique to a specific GPS satellite 20, on the satellite signal. This code is used to identify which GPS satellite 20 transmitted a particular satellite signal. Each chip is a value of +1 or −1, and the C/A code appears to be a random pattern. The C/A code superimposed on the satellite signal can therefore be detected by correlating the satellite signal that was received with the pattern of each C/A code.

Each GPS satellite 20 carries an atomic clock, and the highly precise time information ("GPS time information" below) kept by the atomic clock is included in the satellite signal transmitted by the GPS satellite 20. The time difference of the atomic clock onboard each GPS satellite 20 is measured by the ground control segment, and a time correction parameter for correcting this time difference is also included in the satellite signal. The electronic timepiece 100 receives a satellite signal transmitted from one GPS satellite 20, and adjusts the internal time to the correct time using the GPS time information and time correction parameter contained in the received signal.

Orbit information indicating the position of the GPS satellite 20 on its orbit is contained in the satellite signal. The electronic timepiece 100 can calculate its own position using the GPS time information and orbit information. This position calculation assumes that there is some degree of error in the internal time kept by the electronic timepiece 100. More specifically, in addition to the three parameters for determining the three-dimensional position of the electronic timepiece 100, this time error is also an unknown. The electronic timepiece 100 therefore generally receives satellite signals from four or more GPS satellites, and calculates its own position using the GPS time information and orbit information contained in each of the received signals.

Figure 2:
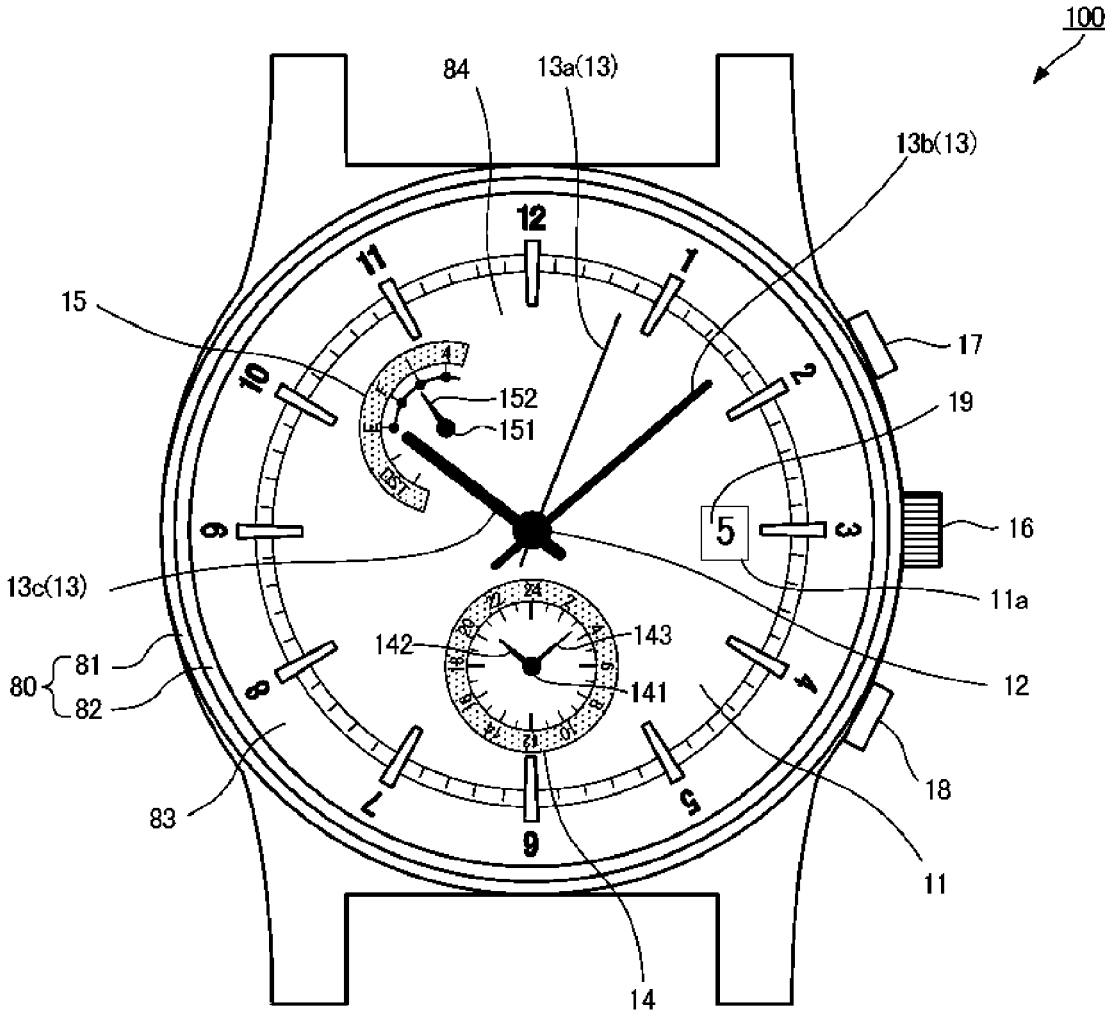
FIG. 2 is a plan view of the electronic timepiece 100.

FIG. 2 is a plan view of the electronic timepiece 100.

As shown in FIG. 2, the electronic timepiece 100 has an outside case 80. The case 80 includes a cylindrical body 81 made of metal or other conductive material, and a bezel 82 that is made of a non-conductive material such as ceramic and pressed into the body 81. The case 80 consists of two parts in this embodiment, but could be embodied as a single part.

A round dial 11 is disposed on the inside circumference side of the bezel 82 through an intervening annular dial ring 83 made of a non-conductive material such as plastic. Hands 13 (13*a* to 13*c*) that turn on a center pivot 12 and indicate the current time are disposed above the dial 11.

As shown in FIG. 2, a subdial 14 and an indicator 15 are also disposed to the dial 11.

The subdial 14 has hands 142 and 143 that rotate on a pivot 141. The hands 142 and 143 display the current time in a location previously set by the user of the electronic timepiece 100. The electronic timepiece 100 can therefore display the current time in two locations by having hands 142 and 143 in addition to hands 13.

The indicator 15 has a hand 152 that can rotate on a pivot 151. The hand 152 indicates the operating mode of the electronic timepiece 100 (that is, whichever of the time information acquisition mode and positioning information acquisition mode is active) when the electronic timepiece 100 is receiving satellite signals, and indicates the reserve power left in the storage battery of the electronic timepiece 100 when not receiving a satellite signal. The user of the electronic timepiece 100 can select whether the hand 152 indicates the operating mode of the electronic timepiece 100, or the hand 152 indicates the reserve power of the storage battery, using a pusher as described below.

The storage battery of the electronic timepiece 100 is also described below.

A date display unit 19 that displays the date is located below the dial 11, and the date display unit 19 can be seen through a window 11*a* in the dial 11.

The dial 11, center pivot 12, hands 13, subdial 14, indicator 15, and date display unit 19 may also be referred to as a time display unit below.

As further described below, the case 80 has two openings, one each on the face and the back cover sides.

The opening on the face side of the case 80 is covered by a crystal 84 through an intervening bezel 82, and the dial 11, hands 13 (13*a* to 13*c*), subdial 14, indicator 15, and date display unit 19 can be seen through the crystal 84.

As also shown in FIG. 2, the electronic timepiece 100 has a crown 16 and pushers 17, 18. The crown 16 and pushers 17, 18 can be manually operated to set the electronic timepiece 100 to either a mode (time information acquisition mode) that receives satellite signals from at least one GPS satellite 20 and adjusts the internal time, or a mode (positioning information acquisition mode) that receives signals from plural GPS satellites 20, calculates the current position, and adjusts the time difference of the internal time. The electronic timepiece 100 can also execute the time information acquisition mode and positioning information acquisition mode regularly (automatically).

Figure 3:
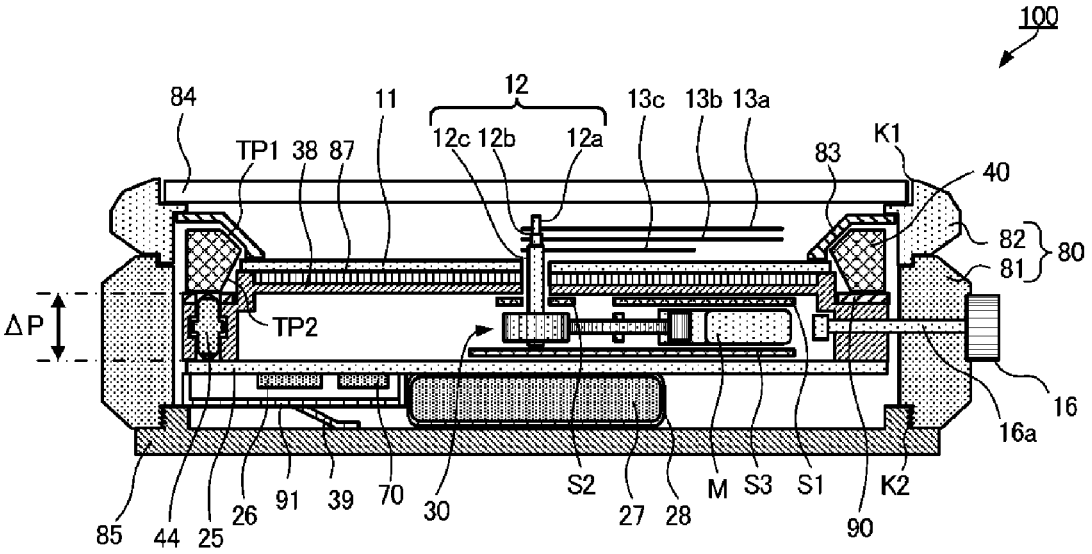
FIG. 3 is a partial section view of the electronic timepiece 100.
Figure 4:
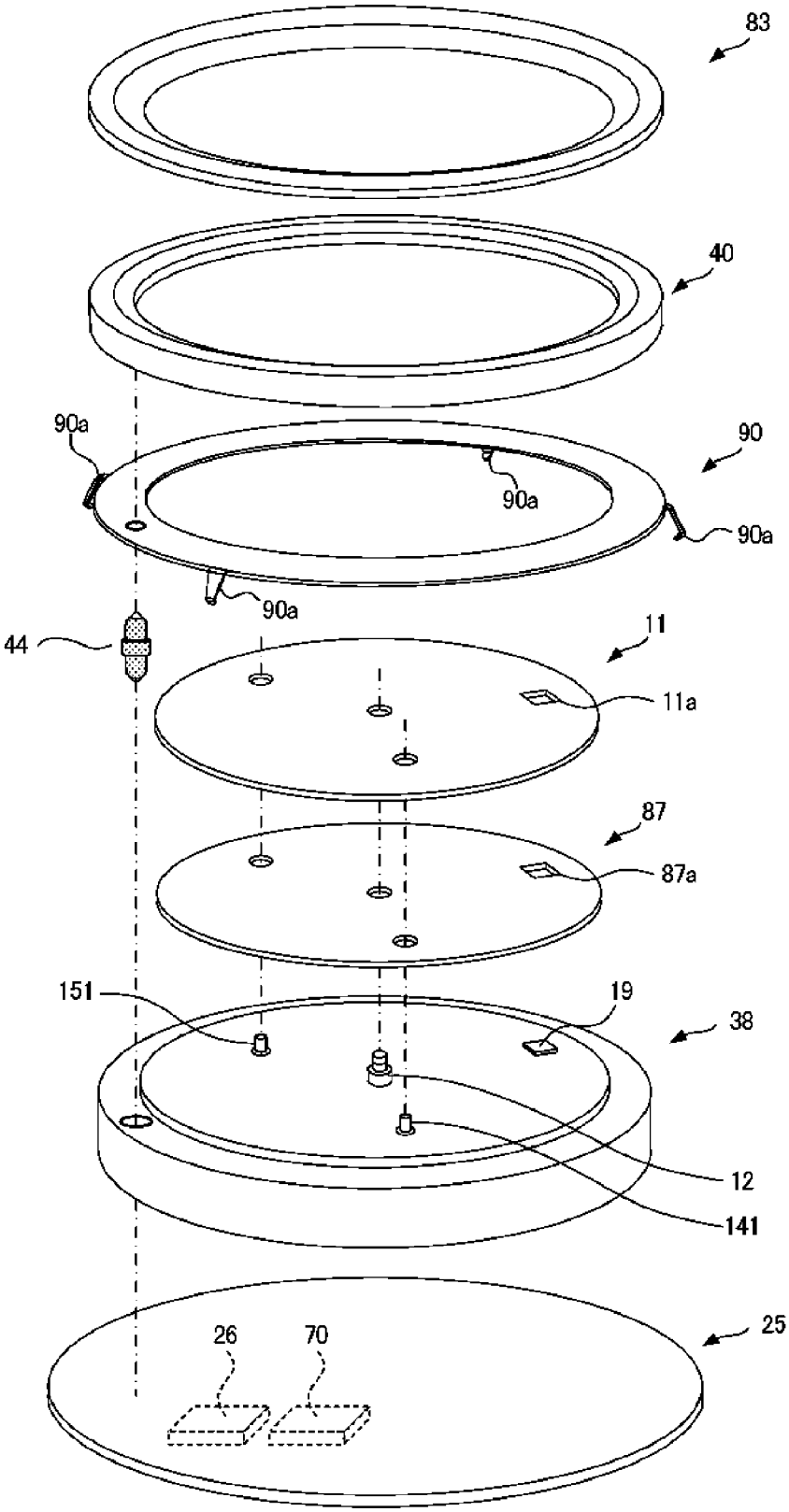
FIG. 4 is an exploded view of part of the electronic timepiece 100.

FIG. 3 is a section view showing the internal structure of the electronic timepiece 100, and FIG. 4 is an exploded oblique view showing parts of the electronic timepiece 100.

As shown in FIG. 3, the case 80 includes a cylindrical body 81 made of metal or other conductive material and a bezel 82 made of a non-conductive material such as ceramic that is pressed into the body 81. The case 80 has a top opening K1 and a bottom opening K2. The top opening K1 of the case 80 is covered by the round crystal 84, and the bottom opening K2 of the case 80 is covered by a back cover 85 made of SUS (stainless steel), Ti (titanium), or other conductive material. The body 81 and back cover 85 screw together, for example.

The ring-shaped dial ring 83 made of plastic or other non-conductive material is disposed to the inside circumference of the bezel 82 below (on the back cover side of) the crystal 84. The main plate 38 made of plastic or other non-conductive material is disposed inside the inside circumference of the body 81 below the dial ring 83.

A donut-shaped storage space is formed by the main plate 38, the dial ring 83, and inside circumference surface of the case 80. The annular antenna 40 is housed in this space. More specifically, the antenna 40 is disposed on the inside side of the inside circumference of the bezel 82, and the top of the antenna 40 is covered by the dial ring 83.

An annular ground plane 90 made of metal or other conductive material is disposed in this space between the antenna 40 and the main plate 38. The ground plane 90 is electrically connected to the body 81 through a plurality of (4 in this embodiment) conductive springs 90*a* made of a conductive material (see FIG. 4 and FIG. 6).

Figure 5A:
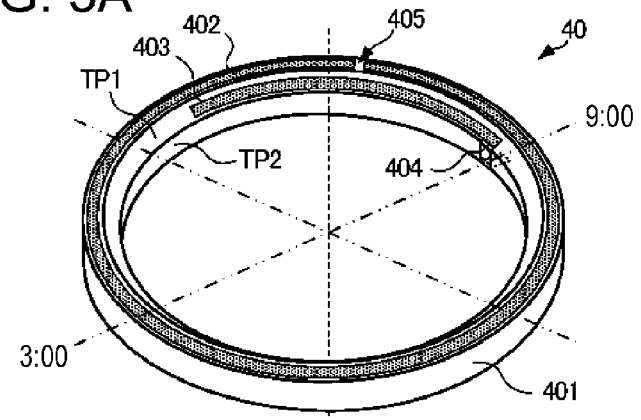
FIG. 5A to FIG. 5C describe the shape of the antenna 40 in the electronic timepiece 100 and the antenna element of the antenna 40.
Figure 5B:
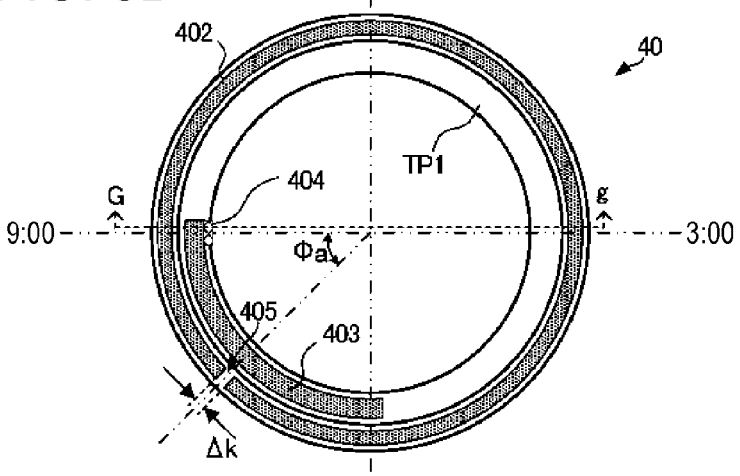
Figure 5C:
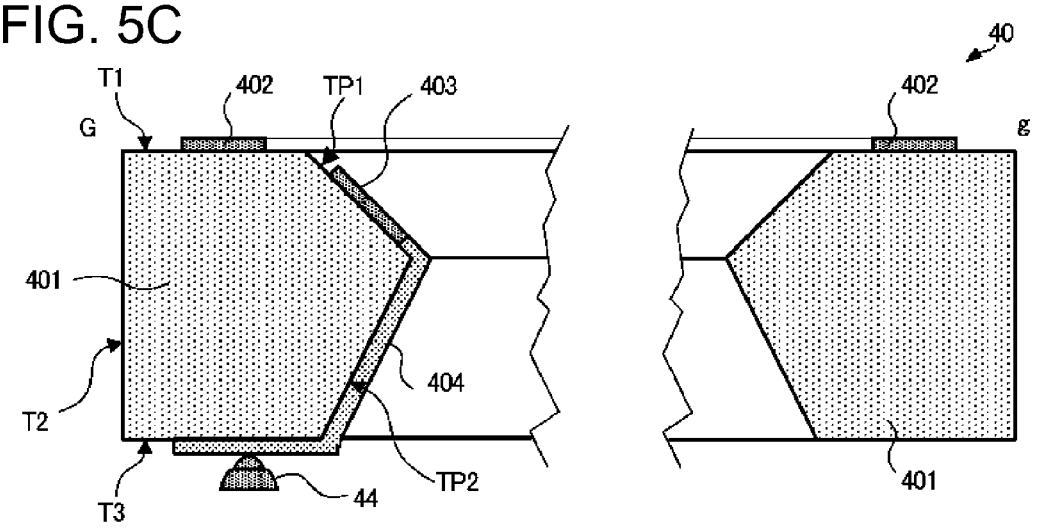

FIG. 5A to FIG. 5C describe the construction of the antenna 40.

FIG. 5A is an oblique view of the antenna 40, FIG. 5B is a plan view of the antenna 40, and FIG. 5C is a section view of the antenna 40 through line G-g in FIG. 5B.

The antenna 40 includes an annular dielectric 401 as a base, and antenna element 402 and antenna element 403 made of metal or other conductive material, and a feed part 404 made of metal or other conductive material, formed by a plating or silver paste printing process.

The dielectric 401 is made with a dielectric constant Σr of approximately 5-20 by mixing a dielectric material that is used in high frequency applications, such as titanium oxide, with resin.

As shown in FIG. 5C, the dielectric 401 has a pentagonal section including a top T1, outside face T2, bottom T3, top slope TP1, and bottom slope TP2 (also referred to as simply slopes below). Antenna element 402 is formed on the top T1 of the dielectric 401, and antenna element 403 is formed on the top slope TP1. The feed part 404 is formed on the top slope TP1, bottom slope TP2, and bottom T3 of the dielectric 401. The antenna element 403 is electrically connected to a feed pin 44 through the feed part 404, and a specific potential is supplied thereto through the feed pin 44. Potential from outside of the antenna 40 is not supplied to the antenna element 402.

As shown in FIG. 5B, the antenna element 402 has a notch 405, and thus forms a C-shape with a notch in the ring. The antenna element 402 has an antenna length that resonates to signals (satellite signals) from a positioning information satellite.

The frequency of signals from GPS satellites 20 is 1.575 GHz, and the length of one wave is approximately 19 cm. Because an antenna length (that is, the circumference of the antenna element 402) of approximately 1.0-1.35 wavelength is required to receive circularly polarized waves, a loop antenna of approximately 19-26 cm is required to receive a signal from a GPS satellite 20. Rendering a loop antenna with this antenna length in a wristwatch, however, results in a large wristwatch.

This embodiment forms the antenna 40 using a dielectric 401 made from a material with a dielectric constant Σr of approximately 5-20 as the base. When using a dielectric 401 with a dielectric constant Σr, the wavelength shortening rate of the dielectric 401 will be $(\in r)^{-1/2}$. More specifically, by using a dielectric 401 with a dielectric constant of ∈r, the wavelength of the radio waves received by the antenna 40 can be shortened $(\in r)^{-1/2}$ times compared with a configuration not using this dielectric 401. In other words, because the antenna 40 according to this embodiment of the invention has a dielectric 401 with a dielectric constant of ∈r, the antenna length of the antenna 40 can be shortened $(\in r)^{-1/2}$ times compared with a configuration not using the dielectric 401, and the size of the antenna can be reduced.

In one example of the specific dimensions of the antenna element 402 when seen in plan view (that is, when the electronic timepiece 100 is seen from the direction perpendicular to the dial 11 or crystal 84), L=1.31λ, Φa=40°, and Δk=0.018λ where the angle between the feed part 404 and the notch 405 from the center of the dielectric 401 is √a, the length of the notch 405 is Δk, the circumferential length of the antenna element 402 is L, and the wavelength of the received circularly polarized waves (the length after wavelength shortening) is ⌊.

As shown in plan view in FIG. 5B, antenna element 403 is C-shaped, that is, a ring with notch removed, when seen in plan view, and is formed with a specific gap (such as a gap of approximately 0.01λ) to antenna element 402. These two antenna elements 402 and 403 are electromagnetically coupled and function as an antenna element that converts electromagnetic waves to current.

The impedance between the antenna 40 and the circuit electrically connected thereto can be matched by desirably setting the length of the antenna element 403.

FIG. 3 and FIG. 4 are referred to again below.

As shown in FIG. 3, an optically transparent dial 11, a center pivot 12 passing through the dial 11 and main plate 38, and plural hands 13 (second hand 13*a*, minute hand 13*b*, hour hand 13*c*) that move around the center pivot 12 and display the current time, are disposed inside the inside circumference of the antenna 40. More specifically, as shown in FIG. 3, the center pivot 12 includes pivot 12*a*, pivot 12*b*, and pivot 12*c*, the second hand 13*a* rotates on pivot 12*a*, the minute hand 13*b* rotates on pivot 12*b*, and the hour hand 13*c* rotates on pivot 12*c*.

While not shown in FIG. 3, pivot 141 passing through the dial 11 and main plate 38, hands 142 and 143 that rotate on the pivot 141, and pivot 151 passing through the dial 11 and main plate 38, and hand 152 that rotates on the pivot 151, are also disposed inside the inside circumference of the antenna 40.

The center pivot 12 extends in the direction between the face and back along the center axis of the case 80 (or the center axis of the antenna 40). Pivot 141 and pivot 151 also extend in the direction between the face and back of the case 80 (see FIG. 4).

The dial 11 is round and made of plastic or other optically transparent non-conductive material. As shown in FIG. 3, the dial 11 is disposed between the crystal 84 and main plate 38. A hole through which the center pivot 12 passes, a hole (FIG. 4) through which the pivot 141 passes, and a hole through which the pivot 151 (FIG. 4) passes, and the window 11*a* (FIG. 2 and FIG. 4) through which the date display unit 19 can be seen, are formed in the dial 11.

The hands 13, hands 142 and 143, and hand 152 are disposed between the crystal 84 and the dial 11 inside the inside circumference of the antenna 40.

A drive mechanism (drive unit) 30 that for driving the time display unit (hands 13, hands 142 and 143, and date display unit 19) is disposed below (on the back cover side of) the main plate 38.

The drive mechanism 30 includes plural stepper motors M1 to M5, and a plurality of wheel trains that drive the corresponding plural stepper motors M1 to M5. The wheel trains each include one or a plurality of wheels. The stepper motors M1 to M5 are also collectively referred to as stepper motor M below.

The drive mechanism 30 drives the plural hands 13 by causing the center pivot 12. More specifically, stepper motor M1 of the drive mechanism 30 drives the pivot 12*a* through the wheel train so that the second hand 13*a* makes one revolution around the center pivot 12 in 60 seconds. Stepper motor M2 of the drive mechanism 30 drives pivot 12*b* through the wheel train so that the minute hand 13*b* makes one revolution around the center pivot 12 in 60 minutes, and drives pivot 12*c* so that the hour hand 13*c* makes one revolution around the center pivot 12 in 12 hours. Stepper motor M3 of the drive mechanism 30 drives the hands 142 and 143 by causing the pivot 141 to rotate through the wheel train. Stepper motor M4 of the drive mechanism 30 drives hand 152 by causing the pivot 151 to rotate through the wheel train. Stepper motor M5 of the drive mechanism 30 drives the date display unit 19 through the wheel train to change the date displayed by the date display unit 19. The drive mechanism 30 thus drives the time display unit.

The electronic timepiece 100 has a circuit board 25 inside the case 80. The circuit board 25 is made of resin, dielectric, or other material, and is disposed below the drive mechanism 30 (that is, between the drive mechanism 30 and the back cover 85).

A circuit block including a GPS reception unit (radio receiver) 26 and control unit 70 is disposed on the bottom (on the surface facing the back of the wristwatch) of the circuit board 25. The GPS reception unit 26 is a single-chip IC module, for example, and includes analog and digital circuits. The control unit 70 sends control signals to the GPS reception unit 26 and controls the reception operation of the GPS reception unit 26, and controls operation of the drive mechanism 30.

A feed pin 44 made of metal or other conductive material is disposed on the top side (face side) of the circuit board 25. The feed pin 44 has an internal spring, passes through a through-hole formed in the main plate 38 and ground plane 90, and contacts the circuit board 25 and the feed part 404 of the antenna 40. The feed part 404 of the antenna 40 is therefore electrically connected to the circuit board 25 (more precisely, to wiring disposed to the circuit board 25) through the feed pin 44, and a specific potential is supplied from a rated potential circuit (not shown in the figure) on the circuit board 25 to the feed part 404.

The circuit board 25 and feed part 404 are electrically connected by the feed pin 44 in this embodiment, but the feed pin 44 is only one example of a feed member that electrically connects the circuit board 25 and feed part 404, and the circuit board 25 and feed part 404 can be electrically connected by another member made of a conductive material, such as a lead or leaf spring, instead of the feed pin 44. For example, the feed pin 44 could have an internal spring. More specifically, the feed pin 44 could be any configuration having a conductor that electrically connects the circuit board 25 and feed part 404.

The circuit block including the GPS reception unit 26 and control unit 70 is covered by a shield 91 made of a conductive material. The shield 91 is electrically connected to the ground plane 90 through a circuit support 39, back cover 85, and body 81. The ground potential of the circuit block is supplied to the shield 91. More specifically, the shield 91, back cover 85, body 81, and ground plane 90 are held at the ground potential of the circuit block, and function as a ground plane.

Magnetic screen S1 and magnetic screen S2 are disposed between the drive mechanism 30 and main plate 38, and another magnetic screen S3 is disposed between the drive mechanism 30 and circuit board 25. Magnetic screen S1 and magnetic screen S2 are together referred to below as a first magnetic screen, the magnetic screen S3 as a second magnetic screen. Magnetic screens S1 to S3 are made of a conductive material with high permeability, such as pure iron.

If there is a speaker or other object that produces a strong magnetic field outside of the electronic timepiece 100, the stepper motors M may operate incorrectly due to the effect of the magnetic field. Of the parts of the electronic timepiece 100, metal in the body 81 and back cover 85 produces a magnetic field when magnetized. Circuit blocks on the circuit board 25 can also produce a magnetic field.

By covering the stepper motors M with magnetic screens S1 to S3 made of a material with high permeability, this embodiment of the invention magnetically shields the drive mechanism 30 and prevents the stepper motor M from operating incorrectly due to the magnetic fields described above.

A lithium ion battery or other cylindrically shaped storage battery 27, a battery compartment 28 for holding the storage battery 27, and a solar panel 87 that generates power by photovoltaic conversion, are also disposed inside the case 80 of the electronic timepiece 100.

The solar panel 87 is a round disc having plural solar cells (photovoltaic devices) that convert light energy to electrical energy (power) connected in series. The solar panel 87 is disposed inside the inside circumference of the antenna 40 and between the main plate 38 and dial 11. A hole through which the center pivot 12 passes, a hole (FIG. 4) through which the pivot 141 passes, a hole (FIG. 4) through which the pivot 151 passes, and a window 87*a* (FIG. 2 and FIG. 4) for viewing the date display unit 19, are formed in the middle part of the solar panel 87.

The storage battery 27 is charged by the power produced by the solar panel 87. The battery compartment 28 for holding the storage battery 27 is below the circuit board 25 (that is, between the circuit board 25 and back cover 85).

The crown 16, pusher 17, and pusher 18 (FIG. 2) are disposed to the outside of the case 80. Movement of the crown 16 resulting from the user of the electronic timepiece 100 operating the crown 16 is transferred through the stem 16*a* passing through the case 80 to the drive mechanism 30. Movement of the pusher 17 (or pusher 18) produced by the user of the electronic timepiece 100 pressing the pusher 17 (or pusher 18) is transferred to a switch not shown through the corresponding button stem 17*a* (or button stem 18*a*) (see FIG. 7) passing through the case 80. These switches convert pressure from the pusher 17 (or pusher 18) to an electrical signal, and output the signal to the control unit 70.

The crown 16, stem 16*a*, pushers 17, 18, and button stems 17*a* and 18*a* are also referred to below as operating units.

Figure 6:
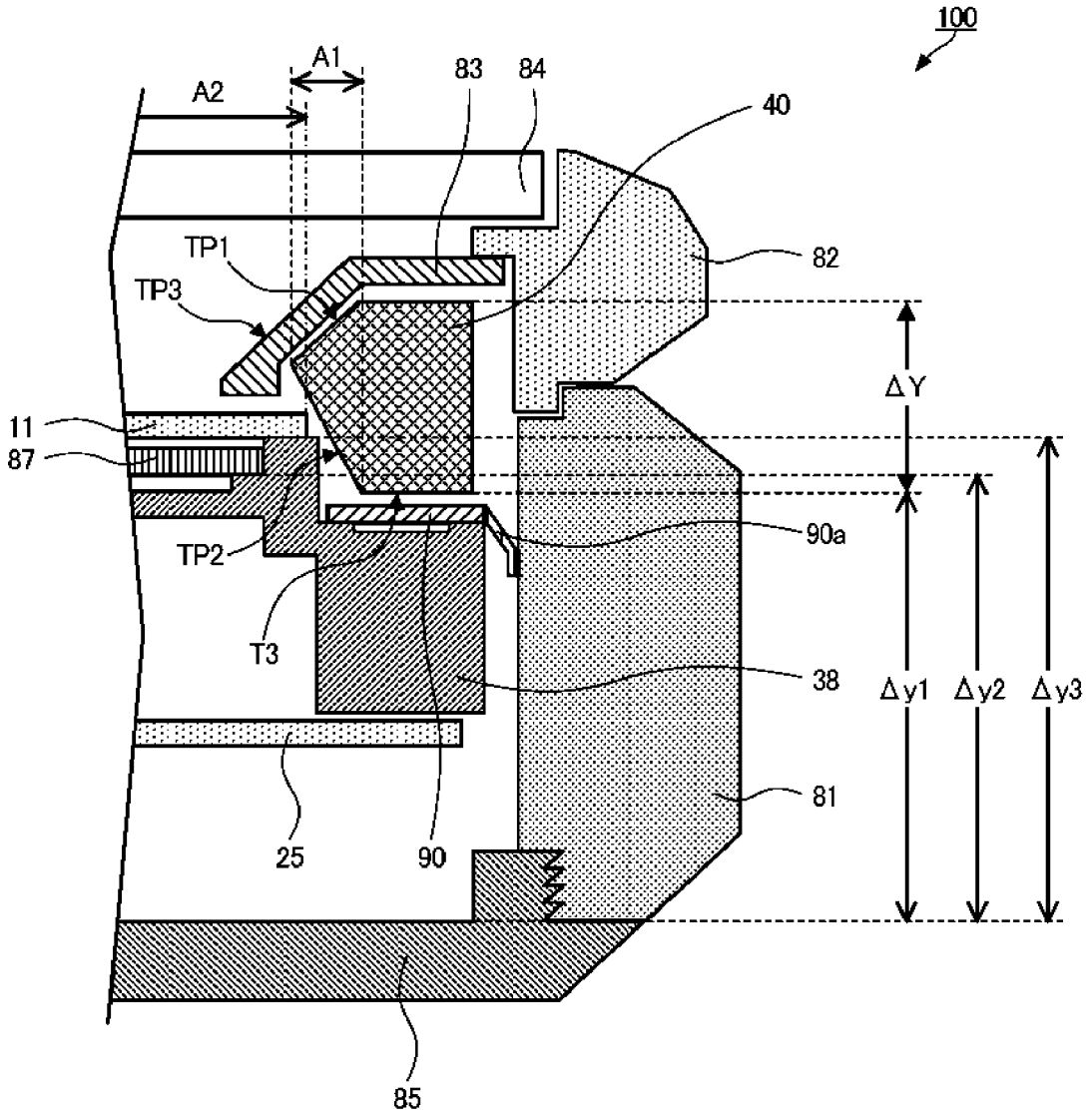
FIG. 6 is a section view of part of the electronic timepiece 100.

The relative positions of the antenna 40, dial 11, and solar panel 87 are described next with reference to FIG. 6. FIG. 6 is a section view of part of the electronic timepiece 100.

In this embodiment as shown in FIG. 6, the dial 11 and solar panel 87 are disposed to a position closer to the top of the electronic timepiece 100 than the bottom T3 of the antenna 40. More specifically, if the distance between the antenna 40 and back cover 85 is Δy1, the distance between the solar panel 87 and back cover 85 is ⊗y2, and the distance between the dial 11 and back cover 85 is ⊗y3, the antenna 40 is disposed so that ⊗y1<Δy2<Δy3.

When the antenna 40 is disposed so that the bottom T3 of the antenna 40 is positioned on the back cover side of the dial 11 and solar panel 87 as in this embodiment, the thickness ΔY of the antenna 40 in the front-back direction can be greater than when the antenna 40 is disposed so that the bottom T3 is on the face side of the dial 11 and solar panel 87.

The reception performance of the antenna 40 improves as the section area of the antenna 40 increases. Therefore, because the thickness ⊗Y of the antenna 40 in the face-back direction can be increased and the section area of the antenna 40 can be increased in this embodiment, better reception performance can be achieved than when the antenna 40 is disposed on the face side of the dial 11 and solar panel 87.

The dial 11 and solar panel 87 are both disposed on the face side of the bottom T3 of the antenna 40 in this embodiment, but the invention is not so limited. The dial 11 only could be disposed closer to the face than the bottom T3 of the antenna 40. More specifically, the antenna 40 can be disposed so that the relationship Δy2<Δy1<Δy3 is true. This configuration can also ensure that the thickness ⊗Y in the face-back direction of the antenna 40 provides the section area of the antenna 40 required for the antenna 40 to achieve good reception performance, and good reception performance can therefore be maintained in the antenna 40.

The antenna 40 (dielectric 401) in the foregoing embodiment has a bottom slope TP2. As shown in FIG. 6, the bottom slope TP2 is on the inside circumference of the antenna 40, and is a slope that increases in distance from the back cover 85 with proximity to the center of the antenna 40 (that is, proximity to the center pivot 12). When seen in plan view, the dial 11 is disposed superimposed with part of the bottom slope TP2. More specifically, if the area where the bottom slope TP2 is located in plan view is area A1 and the area where the dial 11 is disposed in plan view is area A2, the dial 11 is disposed so that part of area A1 and part of area A2 overlap. As a result, the area of the dial 11 in plan view is greater in this embodiment than in a configuration in which the dial 11 is disposed so that area A1 is not superimposed with area A2, the freedom of design of the electronic timepiece 100 can be improved, and the visibility of the time and other information displayed on the time display unit can be improved.

As shown in FIG. 6, the antenna 40 (dielectric 401) according to this embodiment of the invention also has a top slope TP1. A top slope TP3 can therefore also be rendered on the dial ring 83 that is disposed on the face side of the antenna 40.

When this top slope TP3 is not provided, the edge of the dial 11 is hidden by the dial ring 83 and cannot be seen by the user when looking at the dial 11 from diagonally above in FIG. 6, for example. However, because the dial ring 83 according to this embodiment of the invention has this top slope TP3, the user can see letters and markers disposed to the dial 11 and dial ring 83 from a wider angle of view.

Figure 7:
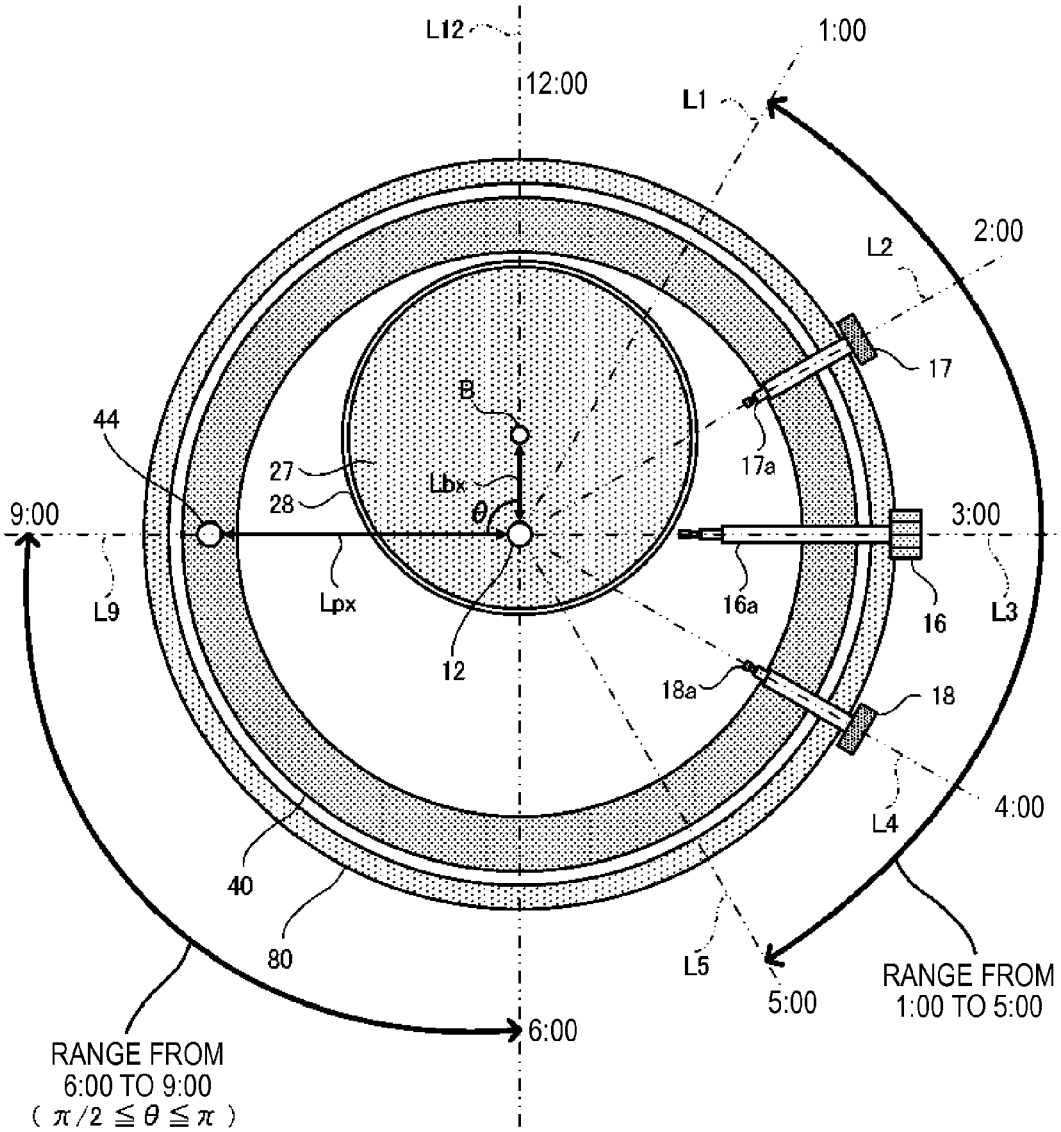
FIG. 7 describes the relative positions of the antenna 40, feed pin 44, and storage battery 27 in the electronic timepiece 100.

FIG. 7 shows the relative positions of the case 80, antenna 40, feed pin 44, storage battery 27 and battery compartment 28, and operating units (crown 16, stem 16*a*, pushers 17, 18, and button stems 17*a* and 18*a*) when seen in plan view (that is, when the electronic timepiece 100 is seen from the direction perpendicular to the dial 11).

As shown in FIG. 7, the battery compartment 28 is disposed so that the storage battery 27 (more specifically, the storage battery 27 housed in the battery compartment 28) and the antenna 40 do not overlap when seen in plan view.

The feedpin 44 is also disposed to a position not superimposed with the storage battery 27 held in the battery compartment 28 when seen in plan view.

The storage battery 27 absorbs or reflects electromagnetic waves, including radio waves (satellite signals) from GPS satellites 20. Good reception performance therefore cannot be maintained in the antenna 40 when the storage battery 27 is disposed near the antenna 40 because the storage battery 27 absorbs or reflects radio waves that the antenna 40 could receive if the storage battery 27 was not present.

More particularly, the gain of the antenna 40 is greatest in the direction of the feed part 404 from the center of the antenna 40 (that is, the direction from the antenna 40 to the feed part 404 is the same as the direction of maximum antenna 40 radiation). The reception performance of the antenna 40 therefore drops greatly when the feed pin 44 connected to the feed part 404 is located near the storage battery 27.

This effect of the storage battery 27 on the reception performance of the antenna 40 increases as the distance between the storage battery 27 and antenna 40 decreases, or the distance between the storage battery 27 and feed pin 44 decreases.

The antenna 40 in this embodiment of the invention is therefore disposed to a position where it is not superimposed with the storage battery 27 when seen in plan view, and the feed pin 44 is also disposed to a position where it is not superimposed with the storage battery 27 when seen in plan view.

More specifically, compared with a configuration in which the antenna 40 and storage battery 27 overlap each other in plan view, the configuration of the invention can increase the distance between the antenna 40 and storage battery 27. Compared with a configuration in which the antenna 40 and storage battery 27 overlap each other in plan view, this embodiment of the invention can also increase the distance between the feed pin 44 and storage battery 27.

This embodiment of the invention can therefore minimize the effect of the storage battery 27 on the reception performance of the antenna 40, and maintain good reception performance in the antenna 40.

When seen in plan view in FIG. 7, the line segment joining the feed pin 44 and center pivot 12 is referred to as line segment Lpx below, and the line segment joining the center B of the storage battery 27 in the battery compartment 28 and the center pivot 12 is referred to as line segment Lbx. The feed pin 44 is disposed to a position where the feed pin 44 is superimposed with the antenna 40 in plan view, and the angle θ formed by line segment Lbx and line segment Lpx is greater than or equal to 90 degrees and less than or equal to 180 degrees.

When the feed pin 44 is disposed to a position where angle \ is greater than or equal to 90 degrees and less than or equal to 180 degrees, the distance between the feed pin 44 and storage battery 27 can be increased compared with when the feed pin 44 is disposed to a position where angle θ is a specific angle less than or equal to 90 degrees. The effect of the storage battery 27 on the reception performance of the antenna 40 can therefore be minimized, and a drop in the reception performance of the antenna 40 can be suppressed.

For structural reasons, the battery compartment 28 cannot be disposed to a position superimposed with the operating units (more specifically, the stem 16*a*) in plan view.

The feed pin 44 also cannot be disposed to a position superimposed with the operating units (more specifically, the stem 16*a*, button stem 17*a*, and button stem 18*a*) in plan view.

As a result, the battery compartment 28 and feed pin 44 are disposed where they are not superimposed with the operating units in plan view. For structural reasons, the battery compartment 28 is also disposed where it is not superimposed with the circuit block including the GPS reception unit 26 and control unit 70 (not shown in FIG. 7).

As shown in FIG. 7, the crown 16 and stem 16*a* in this embodiment are disposed at approximately 3:00 relative to the center pivot 12 at the center. More specifically, the crown 16 and stem 16*a* are disposed to a position where ray L3 with its origin at the center pivot 12 intersects the position of 3:00 on the dial 11 (the marker denoting 3:00 on the dial 11 in FIG. 2).

As also shown in FIG. 7, the pusher 17 and button stem 17*a* in this embodiment are disposed at 2:00 relative to the center pivot 12 at the center (that is, the position where ray L2 starting from the center pivot 12 intersects the 2:00 position on the dial 11), and the pusher 18 and button stem 18*a* are disposed at 4:00 relative to the center pivot 12 at the center (that is, the position where ray L4 starting from the center pivot 12 intersects the 4:00 position on the dial 11).

The operating units in this embodiment of the invention are thus disposed in the range between 1:00 and 5:00 in plan view. In other words, the operating units are disposed in the area on the right side of ray L1 extending from the center pivot 12 to the position at 1:00 on the dial 11, and the right side of ray L5 extending from the center pivot 12 to the position at 5:00 on the dial 11.

As described above, the battery compartment 28 must be disposed to a position not superimposed with the crown stem 16*a* in plan view, and the feed pin 44 must be disposed to a position not superimposed with the crown stem 16*a* and button stems 17*a* and 18*a* in plan view. The battery compartment 28 and feed pin 44 in this embodiment are therefore disposed to the area between 6:00 and 12:00. More precisely, the feed pin 44 is disposed to a position in plan view intersecting line L12 extending through the center pivot 12 and the 12:00 position, or a position on the 9:00 side of line L12. The battery compartment 28 is disposed to a position in plan view where the center B of the storage battery 27 intersects line L12, or a position on the 9:00 side of line L12.

As a result, the battery compartment 28 and feed pin 44 can be disposed to a position not superimposed with the operating units in plan view.

As also described above, the feed pin 44 in this embodiment is disposed to a position where the angle θ formed by line segment Lbx and line segment Lpx is greater than or equal to 90 degrees and less than or equal to 180 degrees. Therefore, when the battery compartment 28 is located so that the center B of the storage battery 27 is positioned in the direction of 12:00, the feed pin 44 is disposed in the range between 6:00 and 9:00 (including the direction of 6:00 and the direction of 9:00). Conversely, when the battery compartment 28 is disposed to that the center B of the storage battery 27 is positioned in the direction of 6:00, the feed pin 44 is disposed in the range between 9:00 and 12:00 (including the direction of 9:00 and the direction of 12:00).

The battery compartment 28 is disposed so that the center B of the storage battery 27 is positioned in the direction of 12:00, and the feed pin 44 is in the direction of 9:00, in this embodiment.

The electronic timepiece 100 can receive satellite signals when outdoors. The electronic timepiece 100 is also often worn on the wrist of the user when outdoors, and the user of the electronic timepiece 100 is often in a posture with the arm pointing down (that is, the opposite direction as the zenith) when outdoors. When outdoors, therefore, the direction from the center (center pivot 12) of the electronic timepiece 100 toward 9:00 is very likely the direction of the zenith.

In this embodiment the feed pin 44 is in the direction of 9:00. As described above, the gain of the antenna 40 is greatest in the direction of the feed part 404, that is, the direction to where the feed pin 44 connects, from the center of the antenna 40. As a result, when the electronic timepiece 100 according to this embodiment of the invention receives satellite signals outdoors, the possibility that the direction of maximum radiation of the antenna 40 is toward the zenith can be increased, and the reception performance of the antenna 40 can be desirably maintained.

The relative positions of the antenna 40 and feed pin 44, and the magnetic screens S1 to S3, are described next with reference to FIG. 8 to FIG. 10.

Figure 8:
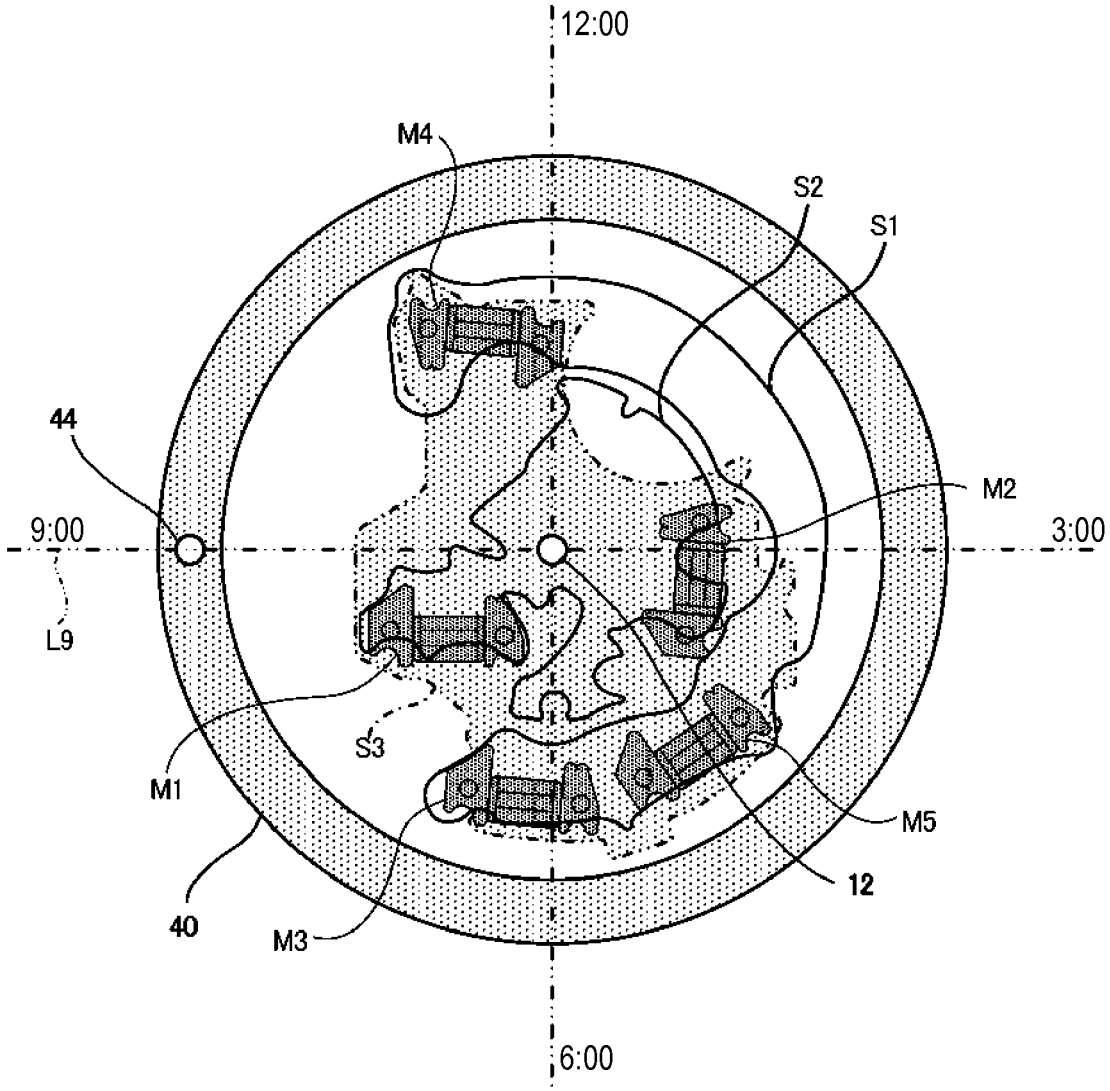
FIG. 8 describes the relative positions of the antenna 40, feed pin 44, magnetic screen S1, magnetic screen S2, and magnetic screen S3 in the electronic timepiece 100.

FIG. 8 shows the relative positions of the antenna 40, magnetic screens S1 to S3, and stepper motors M1 to M5 in plan view.

Figure 9:
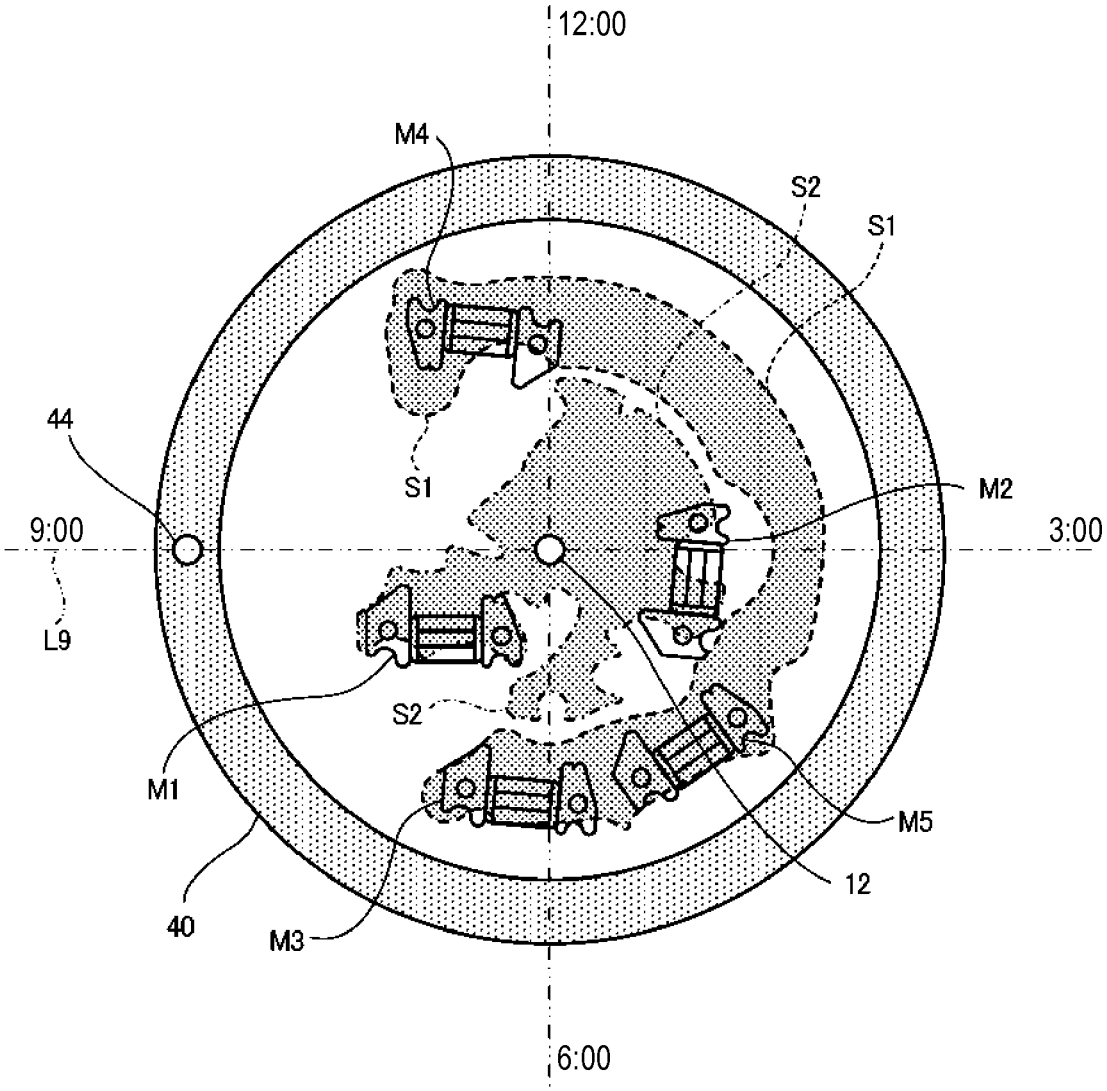
FIG. 9 describes the relative positions of the antenna 40, feed pin 44, magnetic screen S1, and magnetic screen S2 in the electronic timepiece 100.
Figure 10:
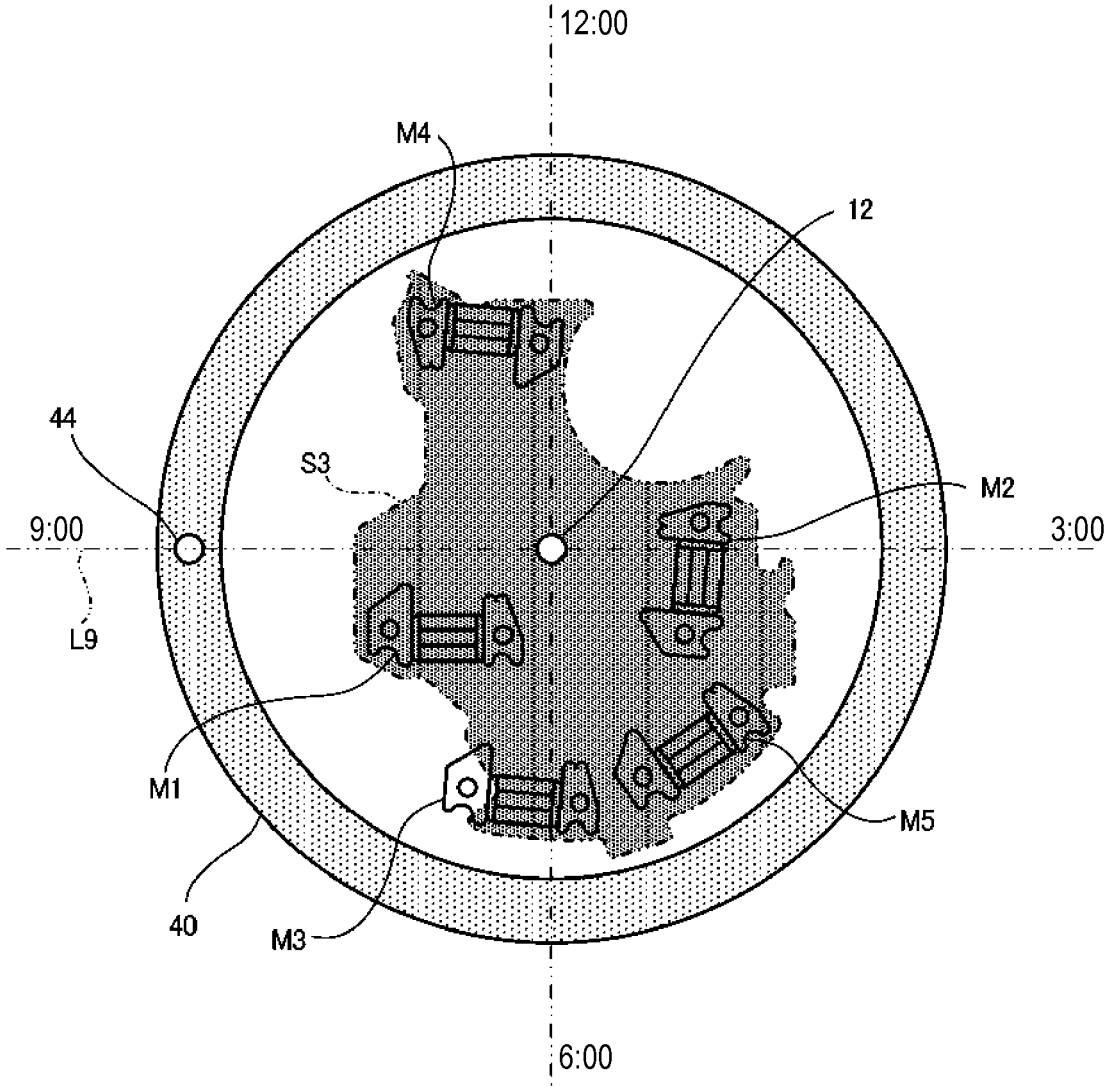
FIG. 10 describes the relative positions of the antenna 40, feed pin 44, and magnetic screen S3 in the electronic timepiece 100.

FIG. 9 omits the magnetic screen S3 from FIG. 8 to describe the relative positions antenna 40, magnetic screen S1 and magnetic screen S2, and stepper motors M1 to M5; and FIG. 10 omits the magnetic screens S1 and S2 from FIG. 8 to describe the relative positions of the antenna 40, magnetic screen S3, and stepper motors M1 to M5.

As shown in FIG. 8 and FIG. 9, the magnetic screens S1 and S2 are disposed superimposed with at least part of each stepper motor M. In other words, magnetic screen S1 and magnetic screen S2 are disposed to overlap at least part of the drive mechanism 30 in plan view.

As shown in FIG. 8 and FIG. 10, magnetic screen S3 is disposed superimposed with at least part of each stepper motor Min plan view. In other words, magnetic screen S3 is disposed to overlap at least part of the drive mechanism 30 in plan view.

As a result, each stepper motor M is magnetically shielded from magnetic fields emitted outside of the drive mechanism 30, and incorrect operation of the stepper motors M due to this magnetic field can be prevented.

The magnetic screens S1 to S3 absorb electromagnetic waves, including radio waves (satellite signals) from the GPS satellites 20. As a result, when the electronic timepiece 100 has these magnetic screens S1 to S3, the strength of the signals to be received by the antenna 40 in the radio waves transmitted from a GPS satellite 20 drops, and the reception performance of the antenna 40 drops, compared with a configuration not having these magnetic screens S1 to S3.

The effect of magnetic screens on the reception performance of the antenna 40 is described next with reference to FIG. 11.

Figure 11A:
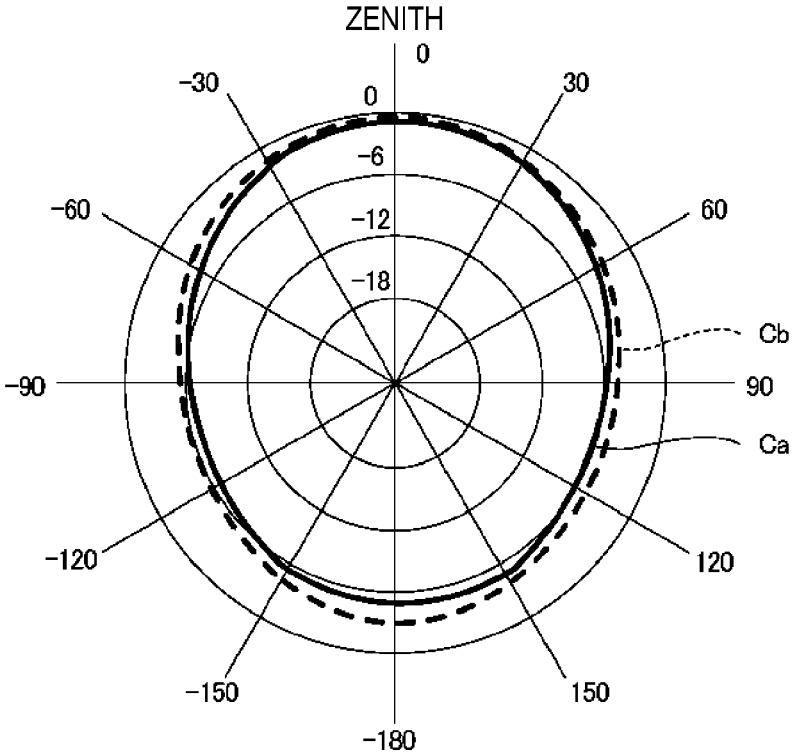
FIG. 11A and FIG. 11B describe the relationship between the reception performance of the antenna 40 in the electronic timepiece 100, and the magnetic screens S1 to S3.
Figure 11B:
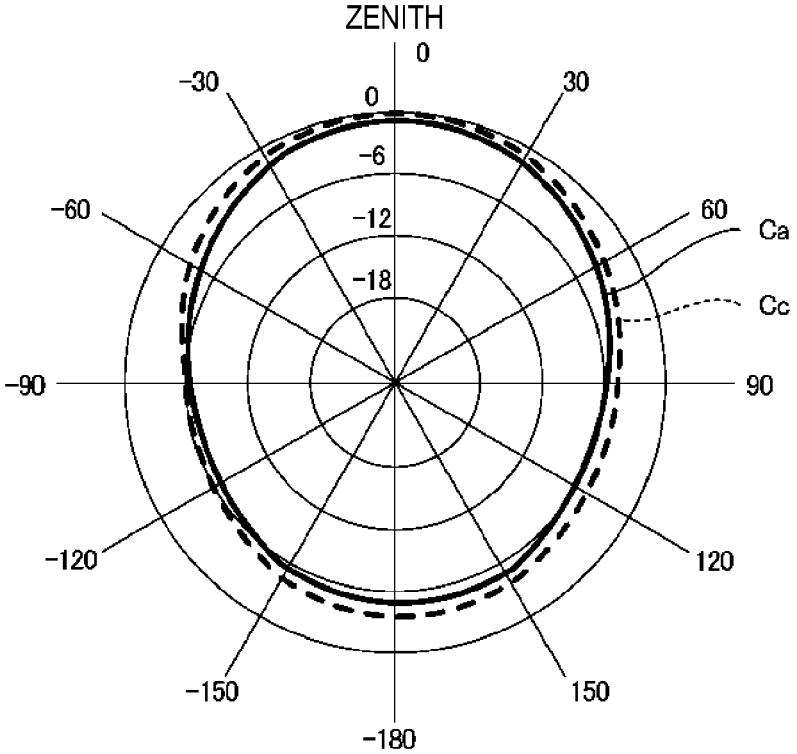

In FIG. 11A and FIG. 11B, solid curve Ca denotes the directivity of the antenna 40 in an electronic timepiece 100 with magnetic screens S1 to S3. Dotted curve Cb in FIG. 11A denotes the directivity of the antenna 140 in an electronic timepiece that omits magnetic screen S1 of the electronic timepiece 100 and has only magnetic screen S2and magnetic screen S3. Dotted curve Cc in FIG. 11B denotes the directivity of the antenna 40 in an electronic timepiece when all of the magnetic screens S1 to S3 of the electronic timepiece 100 are omitted and the electronic timepieces does not have magnetic screens S1 to S3. In each of these figures, the value denoting the gain of the antennas 40 is normalized so that the peak gain of the antenna 40 (the gain in the direction of the zenith) denoted by curve Cc is 0 dB.

As shown by curve Ca, the peak gain of the antenna 40 (the gain in the direction of the zenith) when the electronic timepiece 100 has magnetic screens S1 to S3 is −0.6 dBic, and the average gain (the average gain in all directions) is −3.5 dBic.

As shown by curve Cb, the peak gain of the antenna 40 when magnetic screen S1 is removed from the electronic timepiece 100 is −0.1 dBic, and the average gain is −3.0 dBic.

As shown by curve Cc, the peak gain of the antenna 40 when magnetic screens S1 to S3 are removed from the electronic timepiece 100 is −0.0 dBic, and the average gain is −3.1 dBic.

In other words, removing magnetic screen S1 from the electronic timepiece 100 improves the gain of the antenna 40 in the direction of the zenith 0.5 dBic, and the average gain in all directions 0.5 dBic.

However, removing all magnetic screens S1 to S3 from the electronic timepiece 100 only improves the gain of the antenna 40 in the direction of the zenith 0.6 dBic, and the average gain in all directions 0.4 dBic, and results in substantially the same reception performance as when only magnetic screen S1 is omitted from the electronic timepiece 100.

The effect of the magnetic screen S1 on the reception performance of the antenna 40 is greater than magnetic screen S2 and magnetic screen S3. This is because, as will be known from FIG. 3, magnetic screen S1 is closer to the antenna 40 than magnetic screen S2 and magnetic screen S3.

In other words, reception performance drops when a magnetic screen is disposed near the antenna 40, but good reception performance can be maintained as long as the magnetic screen is disposed with sufficient distance to the antenna 40.

As shown in FIG. 8 to FIG. 10, the antenna 40 is disposed in this embodiment to a position not superimposed with the magnetic screens S1 to S3 in plan view. This enables increasing the distance between the antenna 40 and magnetic screens S1 to S3 when compared with a configuration in which the antenna 40 is disposed to a position superimposed with magnetic screens S1 to S3 in plan view.

This embodiment of the invention can therefore minimize the effect of the magnetic screens S1 to S3 (particularly magnetic screen S1) on the reception performance of the antenna 40, and can desirably maintain the reception performance of the antenna 40.

Note that as described above antenna 40 gain is greatest in the direction from the center of the antenna 40 to the feed part 404. As a result, the reception performance of the antenna 40 is greatly degraded when the feed pin 44 connected to the feed part 404 is located near the magnetic screens S1 to S3.

The feed pin 44 is therefore disposed in the direction of 9:00 from the center pivot 12 in this embodiment. As shown in FIG. 8, magnetic screens S1 to S3 as a group are disposed to a position offset from the center of the electronic timepiece 100 in the direction of 3:00 from the center pivot 12 when seen in plan view. By placing the feed pin 44 in the direction of 9:00, the distance between the feed pin 44 and magnetic screens S1 to S3 can therefore be increased when compared with a configuration having the feed pin 44 disposed to a direction other than 9:00 (such as the direction of 3:00). The effect of the magnetic screens S1 to S3 on the reception performance of the antenna 40 can therefore be minimized, and the reception performance of the antenna 40 can be desirably maintained.

2. Circuit Configuration of the Electronic Timepiece with Internal Antenna

Figure 12:
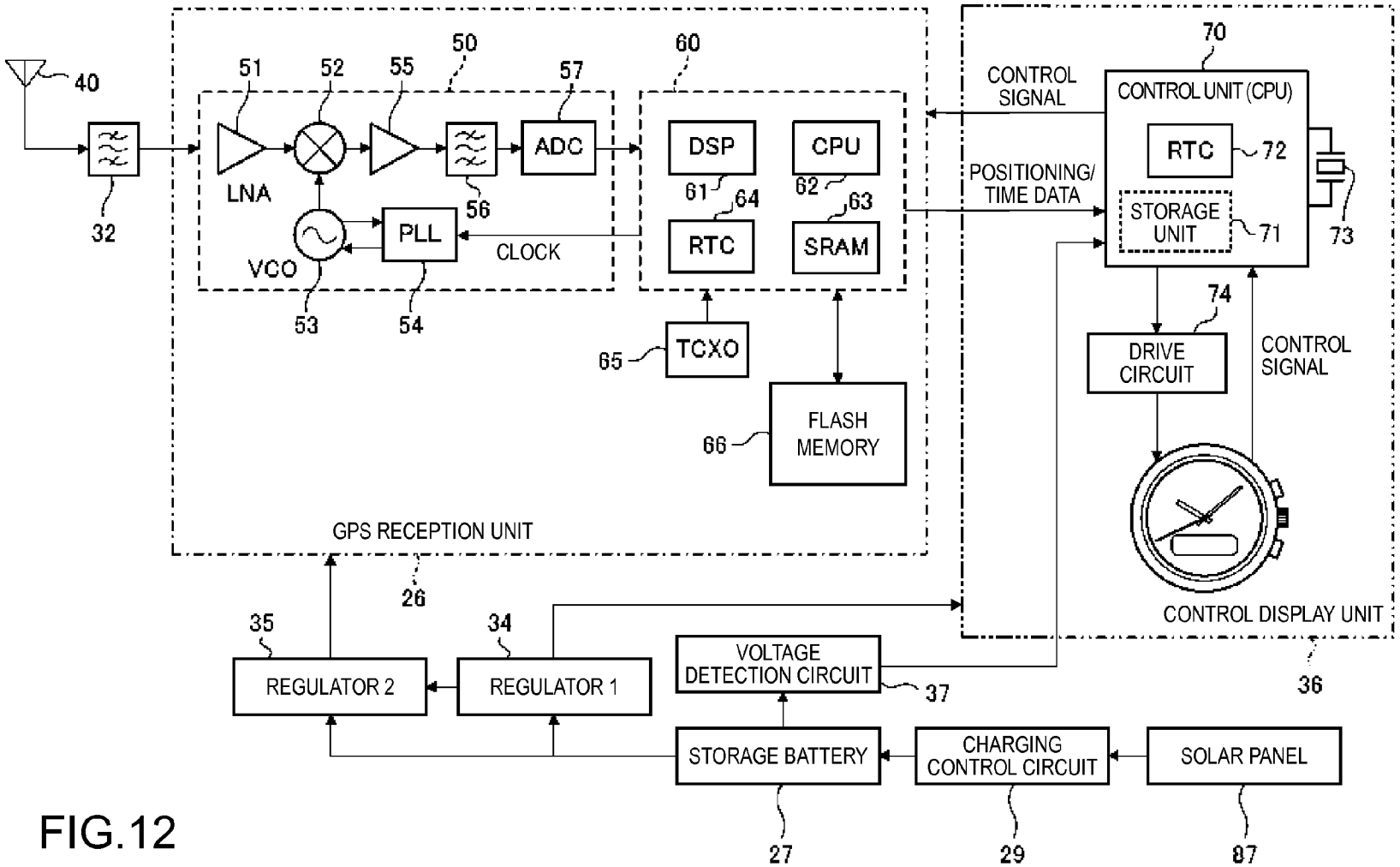
FIG. 12 is a block diagram showing the circuit configuration of the electronic timepiece 100.

FIG. 12 is a block diagram showing the circuit configuration of the electronic timepiece 100.

As shown in FIG. 12, the electronic timepiece 100 includes a GPS reception unit 26 and a control display unit 36. The GPS reception unit 26 executes processes related to receiving satellite signals, locking onto GPS satellites 20, generating positioning information, and generating time correction information, for example. The control display unit 36 executes processes including keeping the internal time and adjusting the internal time.

A solar panel 87 charges the storage battery 27 through the charging control circuit 29.

The electronic timepiece 100 has regulators 34 and 35, and the storage battery 27 supplies drive power through a regulator 34 to the control display unit 36, and supplies drive power through another regulator 35 to the GPS reception unit 26.

The electronic timepiece 100 also has a voltage detection circuit 37 that detects the voltage of the storage battery 27.

Regulator 35 could be split into a regulator (not shown) that supplies drive power to the RF unit 50 (described below), and a regulator (not shown) that supplies drive power to a baseband unit 60 (described below).

The electronic timepiece 100 also has the antenna 40 described above and a SAW (surface acoustic wave) filter 32. As described with reference to FIG. 1, the antenna 40 receives satellite signals from plural GPS satellites 20. However, because the antenna 40 also receives noise in addition to the satellite signals, the SAW filter 32 extracts the satellite signals from the signals received by the antenna 40. In other words, the SAW filter 32 functions as a bandpass filter that passes signals in the 1.5 GHz waveband.

The GPS reception unit 26 includes the RF (radio frequency) unit 50 and baseband unit 60. As described below, the GPS reception unit 26 executes a process that extracts satellite information including GPS time information and orbit information contained in the navigation message from the 1.5 GHz satellite signal extracted by the SAW filter 32.

The RF unit 50 includes a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

The satellite signal passed by the SAW filter 32 is amplified by the LNA 51. The satellite signal amplified by the LNA 51 is mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal, and synchronizes the output clock signal of the VCO 53 to the reference clock signal. As a result, the VCO 53 can output a stable clock signal with the frequency precision of the reference clock signal. Note that several megahertz, for example, can be selected as the intermediate frequency.

The signal from the mixer 52 is amplified by the IF amplifier 55. However, mixing by the mixer 52 also produces a high frequency component of several GHz in addition to the IF signal. The IF amplifier 55 therefore amplifies both the IF signal and the high frequency component of several GHz. The IF filter 56 therefore passes the IF signal and removes the high frequency component of several GHz (more accurately, attenuates the signal to a specific level or less). The IF signal passed by the IF filter 56 is converted to a digital signal by the A/D converter 57.

The baseband unit 60 includes, for example, a DSP (digital signal processor) 61, CPU (central processing unit) 62, SRAM (static random access memory) 63, and RTC (real-time clock) 64. A TCXO (temperature compensated crystal oscillator) 65 and flash memory 66 are also connected to the baseband unit 60.

The temperature compensated crystal oscillator (TCXO) 65 generates a reference clock signal of a substantially constant frequency regardless of temperature. Time zone information, for example, is stored in flash memory 66. The time zone information defines the time difference between the current location and UTC based on specific coordinates (such as latitude and longitude).

The baseband unit 60 executes a process that demodulates the baseband signal from the digital signal (IF signal) output from the A/D converter 57 of the RF unit 50 when set to the time information acquisition mode or the positioning information acquisition mode.

In addition, when the time information acquisition mode or the positioning information acquisition mode is set, the baseband unit 60 executes a process that generates a local code of the same pattern as each C/A code, and correlates the local codes to the C/A code contained in the baseband signal, in the satellite search step. The baseband unit 60 adjusts the timing when the local code is generated to find the peak correlation to each local code, and when the correlation equals or exceeds a threshold value, confirms synchronization with the GPS satellite 20 matching the local code (that is, confirms locking onto a GPS satellite 20). Note that the GPS system uses a CDMA (Code Division Multiple Access) method whereby all GPS satellites 20 transmit satellite signals on the same frequency using different C/A codes. The GPS satellites 20 that can be locked onto can therefore be found by identifying the C/A code contained in the received satellite signal.

To acquire the satellite information from the satellite signal of the GPS satellite 20 that was locked onto in the time information acquisition mode or the positioning information acquisition mode, the baseband unit 60 executes a process that mixes the baseband signal with the local code of the same pattern as the C/A code of the GPS satellite 20 that was locked.

The navigation message containing the satellite information of the GPS satellite 20 that was locked onto is demodulated in the mixed signal. The baseband unit 60 then executes a process to detect the TLM word (preamble data) of each subframe in the navigation message, and acquire (such as store in SRAM 63) satellite information such as the orbit information and GPS time information contained in each subframe. The GPS time information as used here is the week number (WN) and Z count, but the Z count data alone could be acquired if the week number was previously acquired. The baseband unit 60 then generates the time adjustment information required to correct the internal time based on the satellite information.

In the time information acquisition mode, the baseband unit 60 more specifically calculates the time based on the GPS time information, and generates time correction information. The time correction information in the time information acquisition mode may be the GPS time information, or information about the time difference between the GPS time and internal time.

However, in the positioning information acquisition mode, the baseband unit 60 more specifically calculates the position based on the GPS time information and orbit information, and acquires the location information (more specifically calculates the latitude and longitude of the electronic timepiece 100 when the satellite signals were received). Next, the baseband unit 60 references the time difference (time zone) information stored in flash memory 66, and acquires the time difference at the coordinates (such as latitude and longitude) of the electronic timepiece 100 determined from the positioning information. The baseband unit 60 thus generates satellite time data (GPS time information) and time zone (time difference) data as the time correction information. The time correction information used in the positioning information acquisition mode may thus be the GPS time information and time zone information as described above, but the time difference between the internal time and the GPS time could be used instead of the GPS time information.

Note that the baseband unit 60 can generate the time correction information using the GPS time information from one GPS satellite 20, or the baseband unit 60 can generate the time correction information from satellite information from a plurality of GPS satellites 20.

Operation of the baseband unit 60 is synchronized to the reference clock signal output by the TCXO 65. The RTC 64 generates the timing for satellite signal processing, and counts up at the reference clock signal output from the TCXO 65.

The control display unit 36 includes a control unit 70, crystal oscillator 73, and drive circuit 74.

The control unit 70 includes a storage unit 71 and a RTC (real-time clock) 72, and controls various operations. The control unit 70 can be rendered with a CPU, for example. The control unit 70 outputs control signals to the GPS reception unit 26, and controls reception by the GPS reception unit 26. The control unit 70 also controls operation of regulators 34, 35 based on output from the voltage detection circuit 37. The control unit 70 also controls movement of all of the hands 13 through the drive circuit 74, and controls the hands 142 and 143 and the date display unit 19 through the drive circuit 74.

Received data is stored in the storage unit 71. The control unit 70 adjusts the internal time based on the received data.

The internal time is the time kept in the electronic timepiece 100. The RTC 72 operates continuously, and counts up at the reference clock signal generated by the crystal oscillator 73. The control unit 70 can therefore update the internal time and continue moving the hands even when power is not supplied to the GPS reception unit 26.

When the time information acquisition mode is set, the control unit 70 controls operation of the GPS reception unit 26, corrects the internal time based on the GPS time, and stores the time in the storage unit 71. More specifically, the internal time is corrected to UTC (Coordinated Universal Time) by adding a UTC offset to the acquired GPS time.

When set to the positioning information acquisition mode, the control unit 70 controls operation of the GPS reception unit 26, corrects the internal time based on the satellite time data (GPS time) and time zone (time difference) data, and stores the time in the storage unit 71.

3. Benefit of Embodiment 1

As described above, the antenna 40 and feed pin 44 in this embodiment are disposed to a position not superimposed with the magnetic screens S1 to S3 in plan view. More specifically, compared with a configuration in which the antenna 40 and feed pin 44 are superimposed with the magnetic screens S1 to S3 in plan view, this embodiment can increase the distance between the antenna 40 and magnetic screens S1 to S3, and the distance between the feed pin 44 and magnetic screens S1 to S3. This embodiment can therefore minimize the effect of the magnetic screens S1 to S3 on the antenna 40, and can maintain good antenna 40 reception performance.

The storage battery 27 in this embodiment is disposed to a position not superimposed with the antenna 40 and feed pin 44 in plan view. More specifically, compared with a configuration in which the antenna 40 and feed pin 44 are superimposed with the storage battery 27 in plan view, this embodiment can increase the distance between the antenna 40 and storage battery 27, and the distance between the feed pin 44 and storage battery 27. This embodiment can therefore minimize the effect of the storage battery 27 on the reception performance of the antenna 40, and can maintain good antenna 40 reception performance.

The feed pin 44 in this embodiment is also disposed to a position where the angle ∠ formed byline segment Lbx and line segment Lpx is greater than or equal to 90 degrees and less than or equal to 180 degrees. Compared with a configuration in which angle θ is less than 90 degrees, this embodiment of the invention can increase the distance between the feed pin 44 and storage battery 27, and minimize the effect of the storage battery 27 on the antenna 40 through the feed pin 44, and can therefore maintain good antenna 40 reception performance.

The antenna 40 in this embodiment is disposed so that the bottom T3 of the antenna 40 is closer to the back cover than the dial 11 and solar panel 87. This embodiment can therefore increase the thickness ⊗Y in the face-back direction of the antenna 40 compared with a configuration in which the bottom T3 of the antenna 40 is positioned on the face side of the dial 11 and solar panel 87. The section area of the antenna 40 can therefore be increased, and good antenna 40 reception performance can be assured.

At least part of the dial 11 in this embodiment is superimposed with part of the bottom slope TP2 of the antenna 40 (dielectric 401) when seen in plan view. Compared with a configuration in which the dial 11 is disposed so that the dial 11 and bottom slope TP2 are not mutually superimposed in plan view, the configuration of this embodiment can increase the area of the dial 11 in plan view, and can improve the visibility of the time or other information displayed on the time display unit.

The back cover 85, body 81, and ground plane 90 function as a ground plane in this embodiment of the invention. More specifically, because the back cover 85 and the body 81 of the case 80, which have a large volume and area, function as a ground plane in the electronic timepiece 100 according to this embodiment of the invention, the ground potential is stable and good antenna reception performance can be assured.

The antenna 40 (dielectric 401) has a top slope TP1, and the dial ring 83 has a top slope TP3, in this embodiment. Because the height of top slope TP1 and top slope TP3 to the dial 11 decreases with proximity to the center of the antenna 40 (that is, with proximity to the center pivot 12), the user of the electronic timepiece 100 can see to the edges of the dial 11 or other time display unit from a wide angle of view.

Note that because the antenna 40 has a top slope TP1 and bottom slope TP2 in this embodiment, the section area of the antenna 40 is smaller than when the antenna 40 does not have a top slope TP1 and bottom slope TP2. However, because the antenna 40 extends past the solar panel 87 toward the back cover, the reduction in the section area of the antenna 40 resulting from the top slope TP1 and bottom slope TP2 can be compensated for by increasing the thickness ΔY of the antenna 40 in the face-back direction. In other words, this embodiment of the invention can balance maintaining good antenna 40 reception performance with good visibility of the dial 11 or other time display unit.

The feedpin 44 in this embodiment is disposed in the direction of 9:00 from the center pivot 12.

As described above, because the electronic timepiece 100 is worn on the user's wrist, the possibility that the direction toward 9:00 from the center (center pivot 12) of the electronic timepiece 100 will be toward the zenith when outdoors is high. Therefore, by disposing the feed pin 44 in the direction of 9:00 from the center pivot 12, the possibility that the direction of maximum antenna 40 radiation will be toward the zenith when outdoors can be increased, and good antenna 40 reception performance can be maintained.

In addition, the magnetic screens S1 to S3 are disposed as a group to a position offset toward the 3:00 position of the electronic timepiece 100 from the center pivot 12 in plan view. The distance between the feed pin 44 and magnetic screens S1 to S3 can therefore be increased by disposing the feed pin 44 in the direction of 9:00. This embodiment can therefore minimize the effect of the magnetic screens S1 to S3 on the reception performance of the antenna 40, and can maintain good antenna 40 reception performance.

B. Embodiment 2

In the first embodiment described above, the relative positions of the antenna 40 and feed pin 44 to the storage battery 27 and magnetic screens S1 to S3 are determined based conditionally upon the antenna 40 and feed pin 44 not overlapping the storage battery 27 in plan view, and the antenna 40 and feed pin 44 not overlapping the magnetic screens S1 to S3 in plan view.

In this second embodiment of the invention, the location of the feed pin 44, and the location or shape of the magnetic screens S1 to S3, are determined with consideration for the distance between the feed pin 44 and magnetic screens S1 to S3, and the distance between the feed pin 44 and storage battery 27.

An electronic timepiece according to the second embodiment of the invention is described below with reference to FIG. 13 and FIG. 14.

The basic structure of the electronic timepiece according to the second embodiment of the invention is the same as the electronic timepiece 100 according to the first embodiment of the invention described with reference to FIG. 1 to FIG. 12, except that the location of the feed pin 44 is also determined with consideration for the distance to the magnetic screens S1 to S3 and the distance to the storage battery 27 in the second embodiment.

Note that like parts in this embodiment and the electronic timepiece 100 according to the first embodiment of the invention shown in FIG. 1 to FIG. 12 are identified by the same reference numerals used in the first embodiment.

Figure 13:
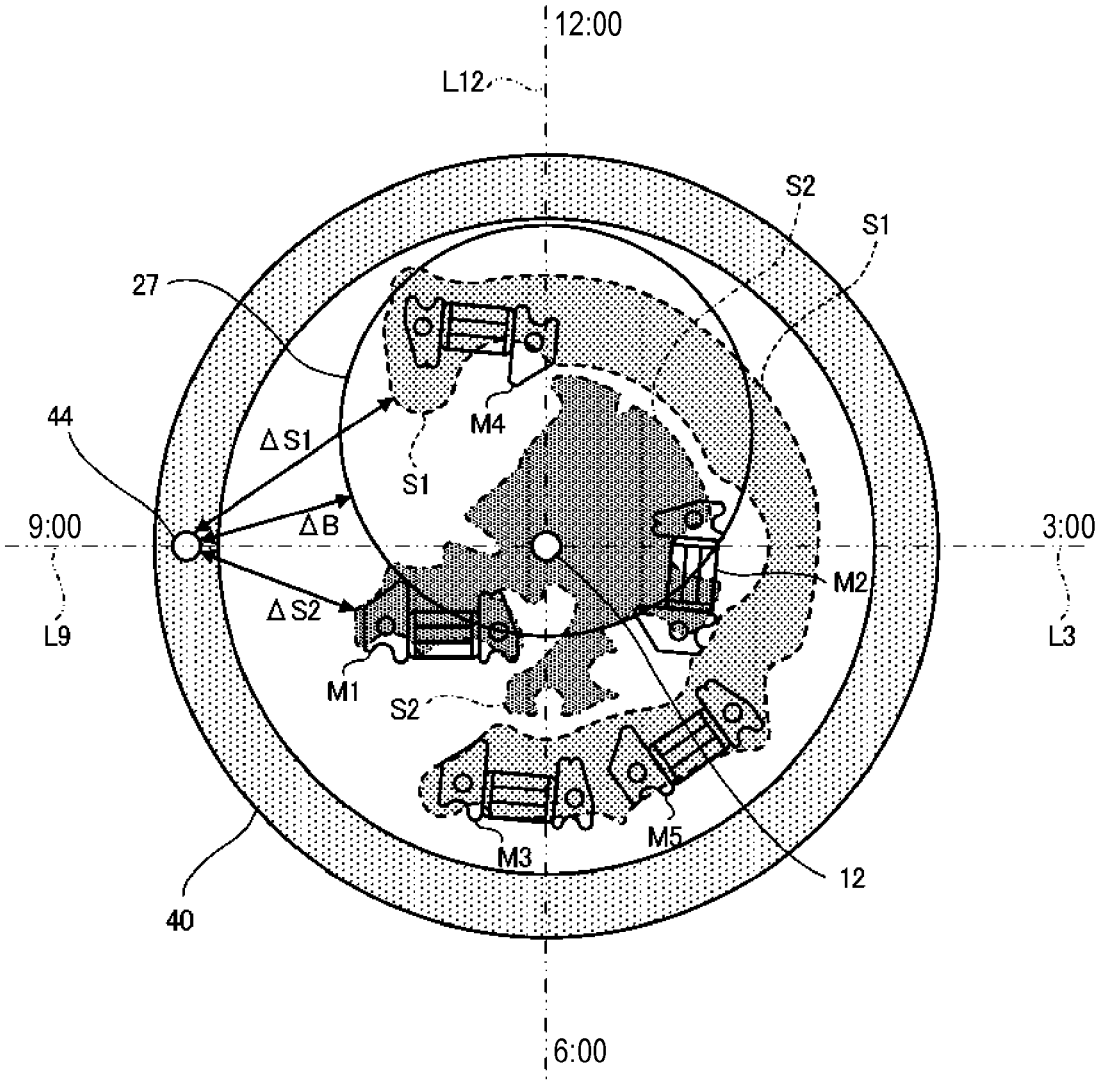
FIG. 13 describes the relative positions of the antenna 40, feed pin 44, storage battery 27, and magnetic screens S1 and S2 in a second embodiment of the invention.
Figure 14:
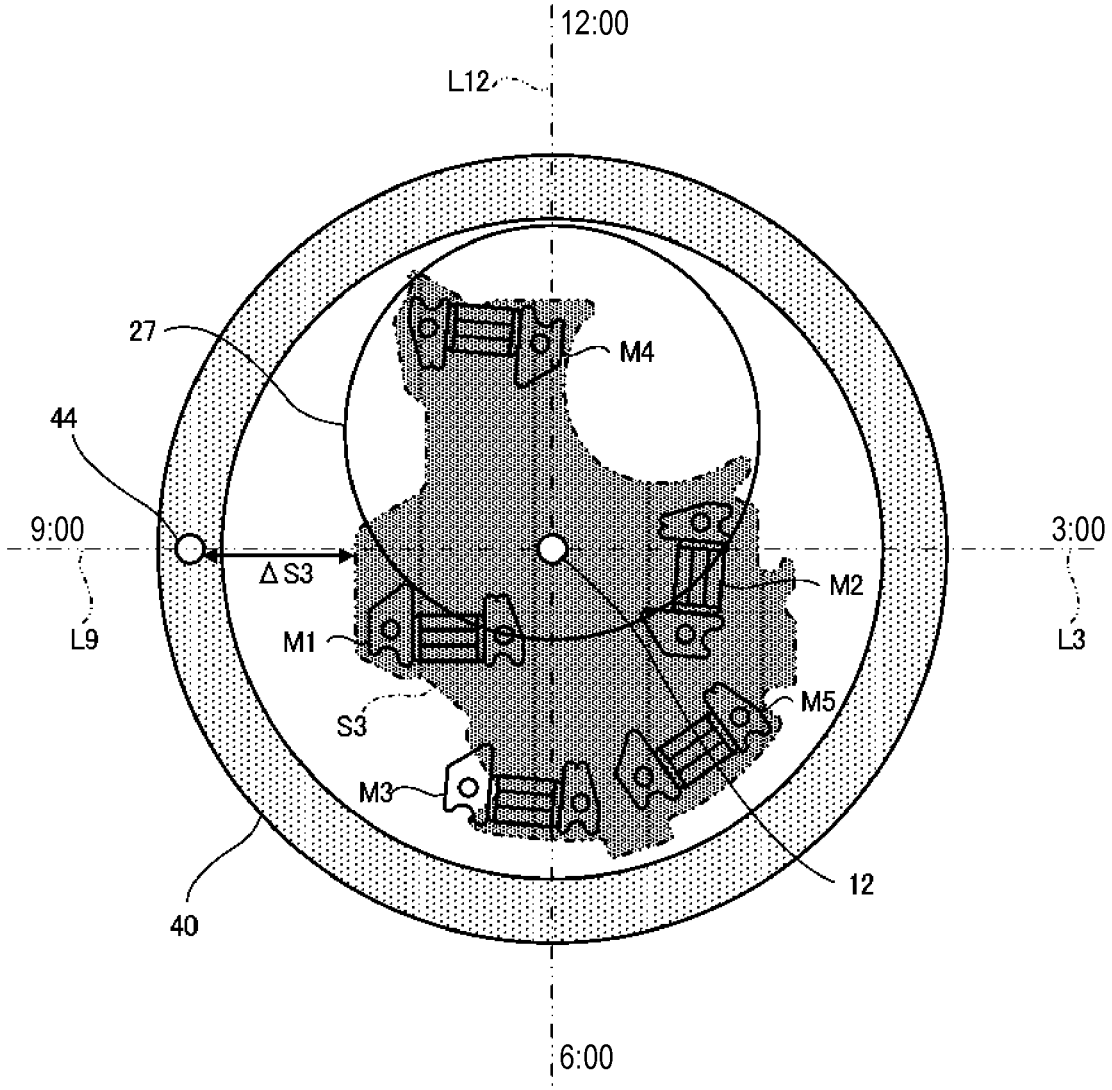
FIG. 14 describes the relative positions of the antenna 40, feed pin 44, storage battery 27, and magnetic screen S3 in a second embodiment of the invention.

FIG. 13 and FIG. 14 show the relative positions of the antenna 40, feed pin 44, storage battery 27, magnetic screens S1 to S3, and stepper motors M1 to M5 in plan view.

As shown in FIG. 13, the magnetic screens S1 and S2 are disposed superimposed with at least part of each stepper motor M. As shown in FIG. 14, magnetic screen S3 is disposed superimposed with at least part of each stepper motor M. As a result, each stepper motor M is magnetically shielded from magnetic fields emitted outside of the drive mechanism 30, and incorrect operation of the stepper motors M due to such magnetic fields can be prevented, as in the first embodiment.

However, parasitic capacitance can occur between the magnetic screens S1 to S3 and antenna 40, or between the magnetic screens S1 to S3 and feed pin 44. Because the resonance frequency between the antenna 40 and ground plane 90 changes when this parasitic capacitance and the capacitance of the antenna 40 couple, good reception performance cannot be maintained in the antenna 40.

The magnetic screens S1 to S3 also absorb electromagnetic waves, including radio waves (satellite signals) from the GPS satellites 20. As a result, when the electronic timepiece 100 has these magnetic screens S1 to S3, the strength of the signals to be received by the antenna 40 in the radio waves transmitted from a GPS satellite 20 drops, and the reception performance of the antenna 40 drops, compared with a configuration not having these magnetic screens S1 to S3.

As described in the first embodiment, the effect of the magnetic screens S1 to S3 on the reception performance of the antenna 40 increases as the distance between the antenna 40 and magnetic screens S1 to S3 decreases, and increases as the distance between the feed pin 44 and magnetic screens S1 to S3 decreases.

As in the first embodiment and shown in FIG. 13 and FIG. 14, the antenna 40 is disposed in this embodiment to a position not superimposed with the magnetic screens S1 to S3 in plan view. As a result, the distance between the antenna 40 and magnetic screens S1 to S3 can be increased compared with a configuration in which the antenna 40 is disposed to a position superimposed with the magnetic screens S1 to S3 in plan view.

As in the first embodiment, the feed pin 44 is also disposed in this embodiment to a position not superimposed with the magnetic screens S1 to S3 in plan view. As a result, the distance between the feed pin 44 and magnetic screens S1 to S3 can be increased compared with a configuration in which the feed pin 44 is disposed to a position superimposed with the magnetic screens S1 to S3 in plan view.

Therefore, as in the first embodiment, because the distance between the antenna 40 and feed pin 44 and the magnetic screens S1 to S3 can be increased, this embodiment can minimize the effect of the magnetic screens S1 to S3 on the reception performance of the antenna 40, and good antenna 40 reception performance can be maintained.

Furthermore, the feed pin 44 is disposed in this embodiment to a position where the distance between the feed pin 44 and magnetic screens S1 to S3 can be made greater than a specific distance in plan view. More specifically, the feed pin 44 is positioned so that the distance ⊗S1 between the feed pin 44 and magnetic screen S1 in plan view, the distance ΔS2 between the feed pin 44 and magnetic screen S2 in plan view, and the distance ΔS3 between the feed pin 44 and magnetic screen S3 in plan view are all greater than the length ΔP of the feed pin 44. As a result, the distance between the feed pin 44 and magnetic screens S1 to S3 can be increased, and good antenna 40 reception performance can be maintained.

The length ΔP of the feed pin 44 is, more precisely, the length of the feed pin 44 when the feed pin 44 is located between the circuit board 25 and antenna 40 as shown in FIG. 3.

That distances ΔS1 to ΔS3 are all greater than the length ΔP of the feed pin 44 is also referred to below as condition 1.

In this embodiment the feed pin 44 and magnetic screens S1 to S3 are also disposed so that distance ΔS1 and distance ΔS2 are greater than or equal to distance ΔS3. More specifically, the feed pin 44 and magnetic screens S1 to S3 are disposed so that ΔS1>=ΔS2>ΔS3, or ΔS2>=ΔS1>ΔS3. For example, FIG. 13 and FIG. 14 show a configuration in which the feed pin 44 and magnetic screens S1 to S3 are disposed where ΔS1>=ΔS2>ΔS3.

Note that distance ΔS1 and distance ΔS2 being greater than distance ΔS3 is also referred to as condition 2 below.

Magnetic screen S3 shields against noise from the circuit block including the GPS reception unit 26 and control unit 70. From the perspective of preventing incorrect operation of the stepper motors M, magnetic screen S3 is therefore more important than magnetic screens S1 and S2. As a result, magnetic screen S3 preferably covers as much of each stepper motor M as possible. In this instance, however, providing sufficient distance between the feed pin 44 and magnetic screen S3 may not be possible.

The feed pin 44 and magnetic screens S1 and S2 are disposed in this embodiment so that at least distance ΔS1 and distance ΔS2 are greater than distance ΔS3 even if distance ΔS3 cannot be made sufficiently long. This enables minimizing the effect of magnetic screens S1 and S2 on the reception performance of the antenna 40 while still preventing incorrect operation of the stepper motors M.

The feed pin 44 and magnetic screens S1 to S3 are also disposed in this embodiment to a position where distance ΔS1 and distance ΔS2 are greater than the distance ΔB between the feed pin 44 and storage battery 27 in plan view.

That distance ΔS1 and distance ΔS2 are greater than distance ΔB is also referred to as condition 3 below.

The storage battery 27 is located below the circuit board 25. The magnetic screens S1 to S3 are located above the circuit board 25. As a result, the feed pin 44, which is located above the circuit board 25, is more easily affected by noise from the magnetic screens S1 to S3 than noise from the storage battery 27. In other words, the effect of the magnetic screens S1 to S3 on the reception performance of the antenna 40 is greater than the effect of the storage battery 27 on the reception performance of the antenna 40.

Because distance ΔS1 and distance ΔS2 are greater than distance ΔB in this embodiment, the total effect of the magnetic screens S1 to S3 and the storage battery 27 on the reception performance of the antenna 40 can be reduced, and good antenna 40 reception performance can be maintained.

As described above, the feed pin 44 is disposed in this embodiment to a position satisfying condition 1 to condition 3 described above. More specifically, compared with a configuration that does not satisfy condition 1 to condition 3, this embodiment can maintain good antenna 40 reception performance because the distance between the antenna 40 and feed pin 44 and the magnetic screens S1 to S3 is long, and the effect of the magnetic screens S1 to S3 on the antenna 40 can be minimized.

Note that the antenna 40 may be disposed in this embodiment so that the bottom T3 of the antenna 40 is on the back cover side of at least one of the dial 11 and solar panel 87 as in the first embodiment, or the antenna 40 may be disposed so that the bottom T3 is conversely on the face side of the dial 11 and solar panel 87.

C. Other Embodiments

The invention is not limited to the foregoing embodiment, and can be varied in many ways such as described in the following variations. One or more of the variations described below can also be desirably combined.

Variation 1

Magnetic screen S1 and magnetic screen S2 are superimposed with at least part of stepper motors M1 to M5 in plan view in the embodiment described above, but could be superimposed with all parts of the stepper motors M1 to M5. In addition, magnetic screen S3 is superimposed with at least part of stepper motors M1 to M5 in plan view in the embodiment described above, but could be superimposed with all parts of the stepper motors M1 to M5.

Magnetic screen S1 and magnetic screen S2 could also be superimposed with all parts of the drive mechanism 30 in plan view, and magnetic screen S3 could be superimposed with all parts of the drive mechanism 30 in plan view. In this configuration, incorrect operation of the stepper motors M due to magnetic fields produced outside of the drive mechanism 30 can be more reliably prevented.

Variation 2

In the foregoing embodiments and variation described above, the magnetic screen S3 does not overlap the antenna 40 in plan view, but could overlap the antenna 40 in plan view.

Figure 15:
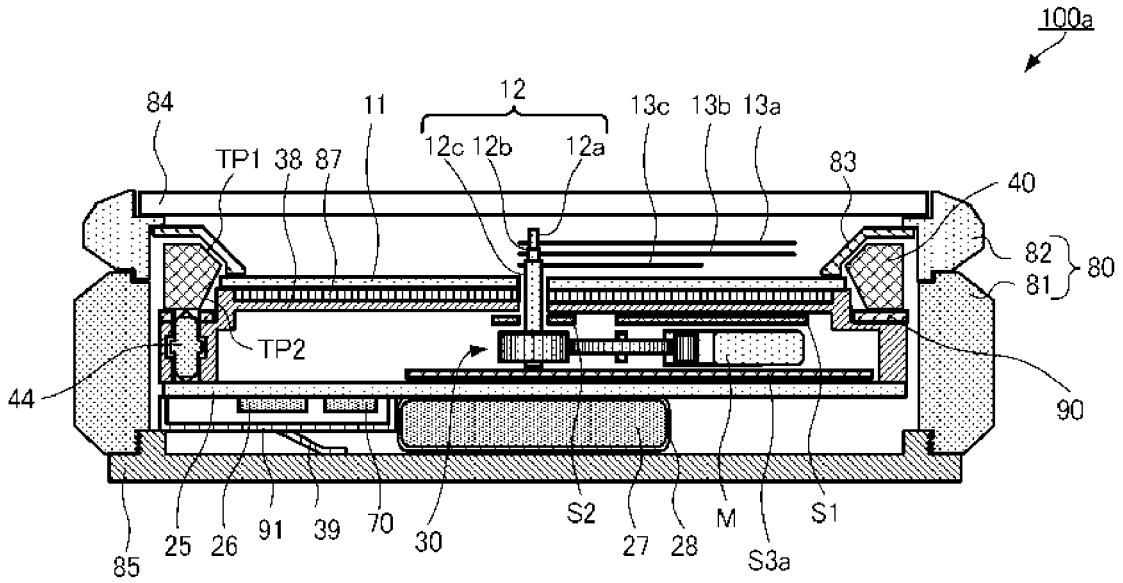
FIG. 15 is a section view of part of an electronic timepiece 100*a* according to a second variation of the invention.

FIG. 15 shows a electronic timepiece 100*a* according to this variation 2. Except for using magnetic screen S3 a instead of the magnetic screen S3 described above, this electronic timepiece 100*a* is identical to the electronic timepiece 100 described above. The magnetic screen S3 a shown in FIG. 15 differs from the above magnetic screen S3 in that it is wider than the magnetic screen S3 shown in FIG. 3 in the right-left direction in the figure, and is superimposed with the antenna 40 in plan view.

As described above, of magnetic screens S1 to S3, magnetic screen S1 has the greatest effect on the reception performance of the antenna 40. Therefore, even if a magnetic screen S3 a that overlaps the antenna 40 in plan view is used instead of the magnetic screen S3 disposed at a position separated from the antenna 40, the effect of the magnetic screen S3 a on the reception performance of the antenna 40 is small, and good antenna 40 reception performance can be maintained even if the magnetic screen S3 a overlaps the antenna 40 in plan view.

Variation 3

In the foregoing embodiments and variations described above, the electronic timepiece 100 (or electronic timepiece 100*a*) has three magnetic screens S1 to S3 (or magnetic screen S3 a), but a configuration having at least one of the three magnetic screens is also conceivable.

For example, of the three magnetic screens, the electronic timepiece 100 (or electronic timepiece 100*a*) could have only magnetic screen S3 (or magnetic screen S3 a). Magnetic screen S3 (S3 a) magnetically shields the stepper motors M1 to M5 from noise from the circuit block including the GPS reception unit 26 and control unit 70. From the perspective of preventing incorrect operation of the stepper motors M, magnetic screen S3 (S3a) is therefore more important than magnetic screens S1 and S2. The possibility of preventing incorrect operation of the stepper motors M1 to M5 is therefore greater if the electronic timepiece 100 (100*a*) has magnetic screen S3 (S3a) even if magnetic screen S1 and magnetic screen S2 are not provided. Better antenna 40 reception performance can also be achieved when the electronic timepiece 100 (100*a*) does not have magnetic screen S1 and magnetic screen S2 than when it has these magnetic screens.

Variation 4

In the foregoing embodiments and variations described above, the feed pin 44 is disposed to a position where the angle θ formed by line segment Lbx and line segment Lpx is greater than or equal to 90 degrees and less than or equal to 180 degrees, but the feed pin 44 simply needs to be disposed to a position where the distance from the storage battery 27 is at least a specific distance. For example, the feed pin 44 can be disposed where the distance ΔB between the feed pin 44 and the storage battery 27 in the battery compartment 28 in plan view is greater than the length ΔP of the feed pin 44.

For example, if the distance between the feed pin 44 and storage battery 27 is greater than or equal to the specific distance, the feed pin 44 can be disposed to any position where angle θ is greater than or equal to 80 degrees and less than or equal to 180 degrees, including when angle θ is 80 degrees.

Figure 16:
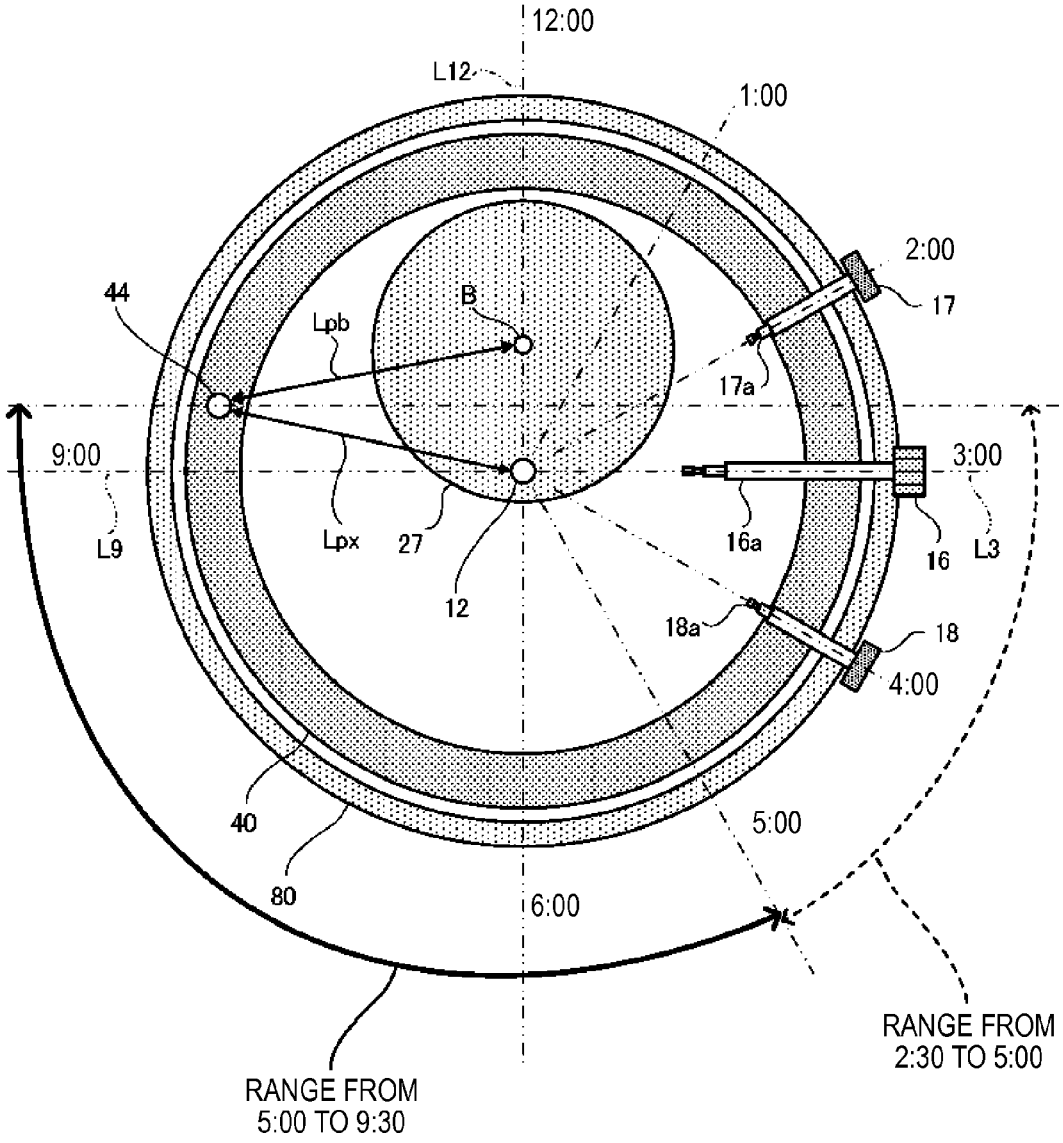
FIG. 16 describes the relative positions of the antenna 40, feed pin 44, and storage battery 27 in an electronic timepiece according to a fourth variation of the invention.

As shown in FIG. 16, the feed pin 44 can be disposed to a position where the length of the line segment Lpx connecting the feed pin 44 and center pivot 12 is less than or equal to the length of the line segment Lpb connecting the feed pin 44 and the center B of the storage battery 27 in the battery compartment 28 in plan view. In the embodiment shown in FIG. 16, the length of line segment Lpb and the length of line segment Lpx are equal when the feed pin 44 is located in the direction of 2:30 or in the direction of 9:30 from the center pivot 12. The feed pin 44 can therefore be disposed in the range from 2:30 to 9:30 from the center pivot 12. However, the feed pin 44 cannot be disposed to a position superimposed with stem 16*a*, button stem 17*a* or button stem 18*a* in plan view. As a result, the feed pin 44 is disposed in the range from 5:00 to 9:30 from the center pivot 12, and not in the range from 2:30 to 5:00.

Note that the position of the feed pin 44 must also be determined in this embodiment with additional consideration for the relative positions of the feed pin 44 and magnetic screens S1 to S3.

Variation 5

The operating units of the electronic timepiece 100 (100*a*) in the foregoing embodiments and variations include crown 16, stem 16*a*, pushers 17, 18, and button stems 17*a*, 18*a*, but configurations having only part of these operating units, and configurations having elements other than these, such as other pushers or buttons, are also conceivable.

For example, the electronic timepiece 100 could be configured without pushers 17, 18 and button stems 17*a*, 18*a*. In this configuration, the feed pin 44 can be disposed to any position not superimposed with the storage battery 27 in the battery compartment 28, the stem 16*a*, or magnetic screens S1 to S3.

Figure 17:
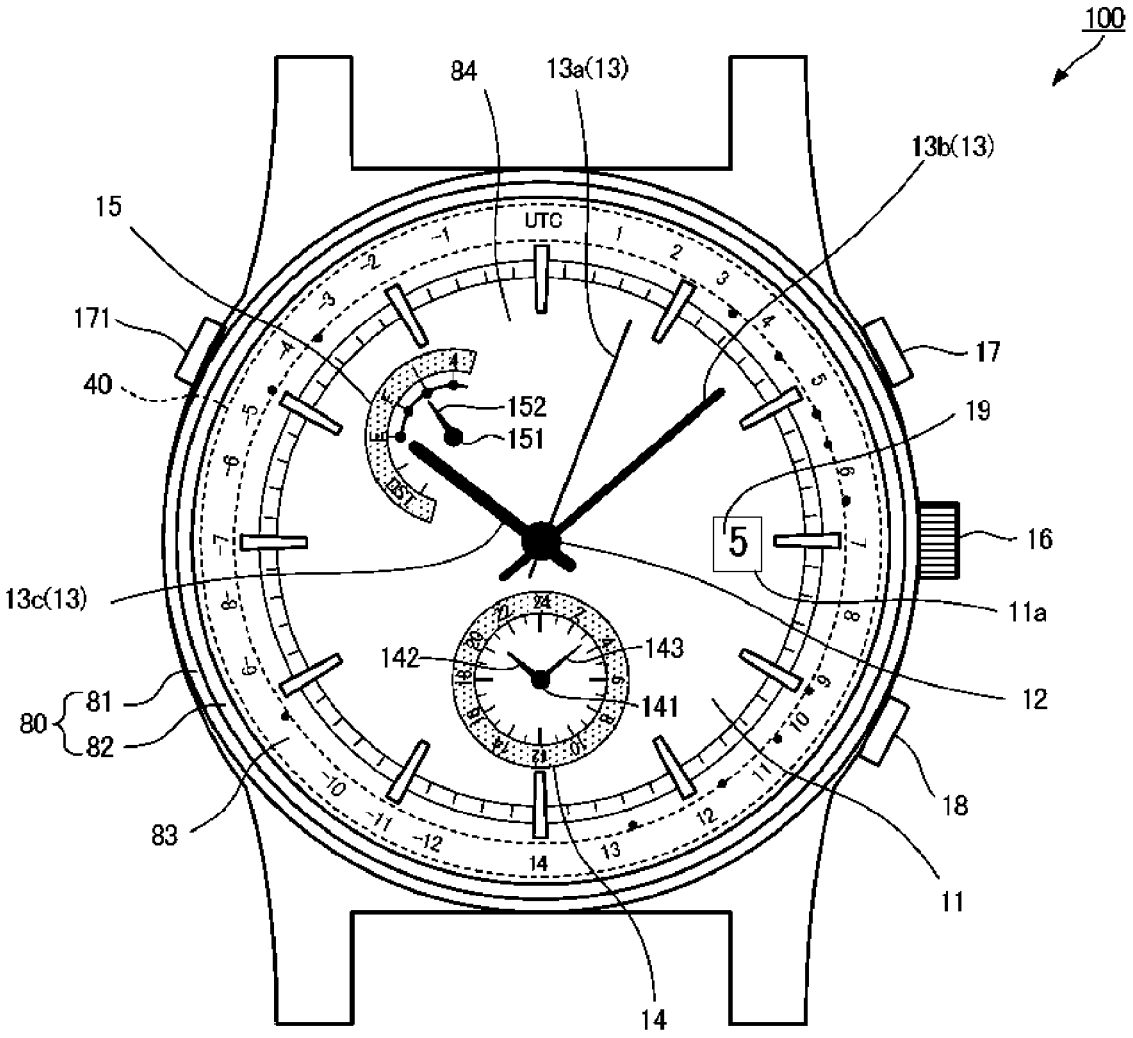
FIG. 17 is a plan view of an electronic timepiece according to a fifth variation of the invention.

As shown in FIG. 17, the electronic timepiece 100 could also have a pusher 171 disposed in the direction of 10:00, for example. In this configuration, the battery compartment 28 and feed pin 44 are disposed to positions also not superimposed with the stem (not shown in the figure) of the pusher 171 in plan view.

Variation 6

In the foregoing embodiments and variations described above, the antenna 40 has a dielectric 401 base with a pentagonal section including a top T1, outside face T2, bottom T3, top slope TP1, and bottom slope TP2 as shown in FIG. 5A to FIG. 5C, but the dielectric forming the base of the antenna could be shaped other than a pentagon in section.

Figure 18A:
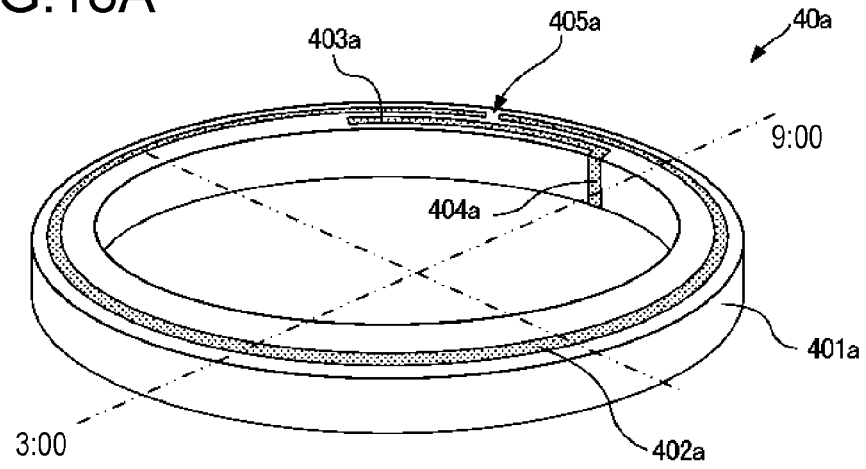
FIG. 18A to FIG. 18C describe an antenna 40*a* according to a sixth variation of the invention.
Figure 18B:
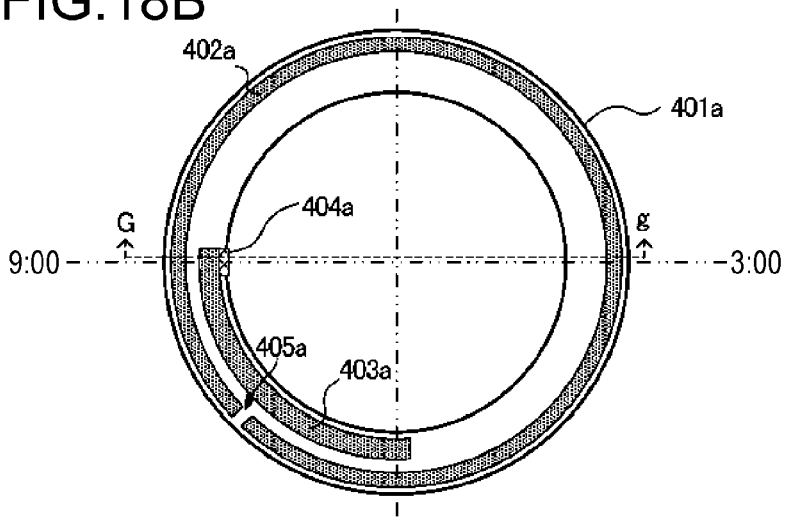
Figure 18C:
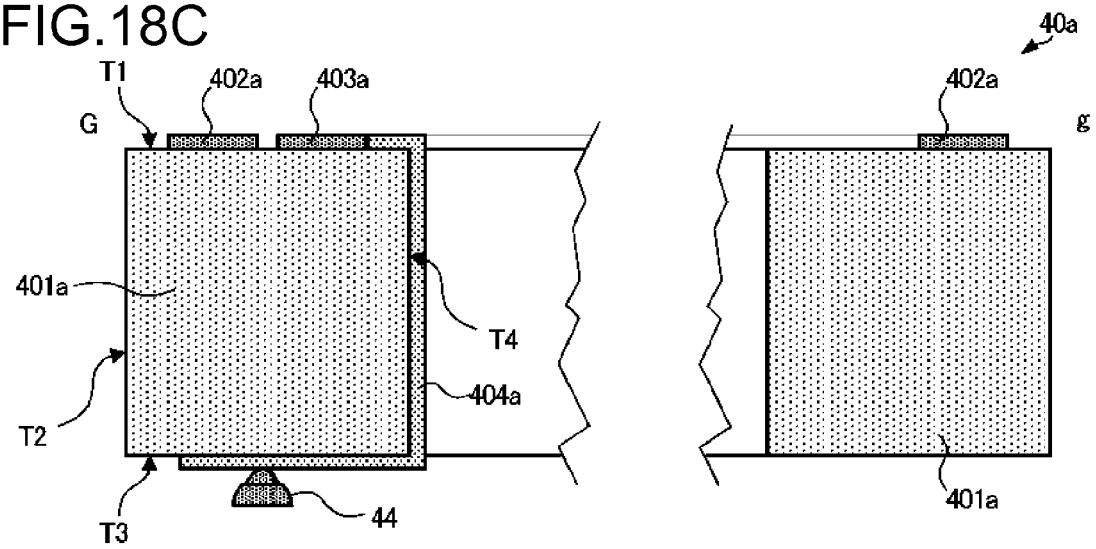

For example, the electronic timepiece 100 could have an antenna 40*a* such as shown in FIG. 18A to FIG. 18C. FIG. 18A is an oblique view of an antenna 40*a* according to variation 6, FIG. 18B is a plan view of the antenna 40*a*, and FIG. 18C is a section view of part of the antenna 40*a* through line G-g in FIG. 18B.

This antenna 40*a* has a dielectric 401*a* base that is rectangular in section, including a top T1, outside face T2, bottom T3, and inside face T4. Antenna elements 402*a* and 403*a* are formed on the top T1 of the dielectric 401*a*, and feed part 404*a* is formed on the top T1, inside face T4, and bottom T3 of the dielectric 401*a*. Antenna element 403*a* is electrically connected to the feed pin 44 through feed part 404*a*. A specific potential is therefore supplied to the antenna element 403*a* through the feed pin 44.

In the foregoing embodiments and variations, antenna element 402 (or 402a) has a notch 405 (or notch 405*a*) and is shaped like a ring with a notch removed, but could be an endless loop without a notch 405 (or notch 405*a*).

Variation 7

In the foregoing embodiments and variations described above, the antenna 40 (or antenna 40*a*) has a parasitic antenna element 402 (or 402*a*), and a driven antenna element 403 (or 403*a*) that is fed a specific potential, but the invention is not so limited and configurations having only a driven antenna element 403 (or 403*a*) that is fed a specific potential, and not having a parasitic antenna element 402 (or 402*a*), are also conceivable.

Figure 19A:
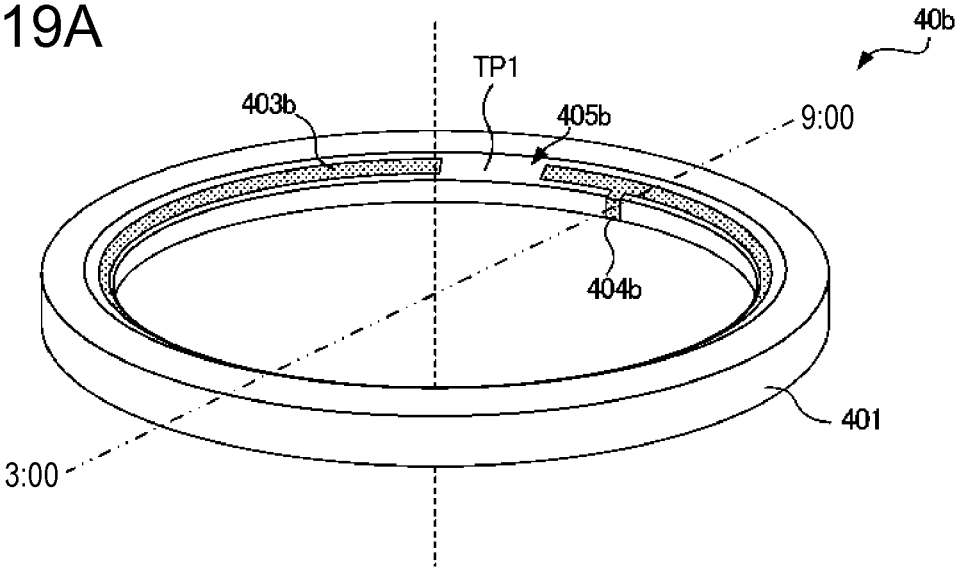
FIG. 19A and FIG. 19B describe an antenna 40*b* according to a seventh variation of the invention.
Figure 19B:
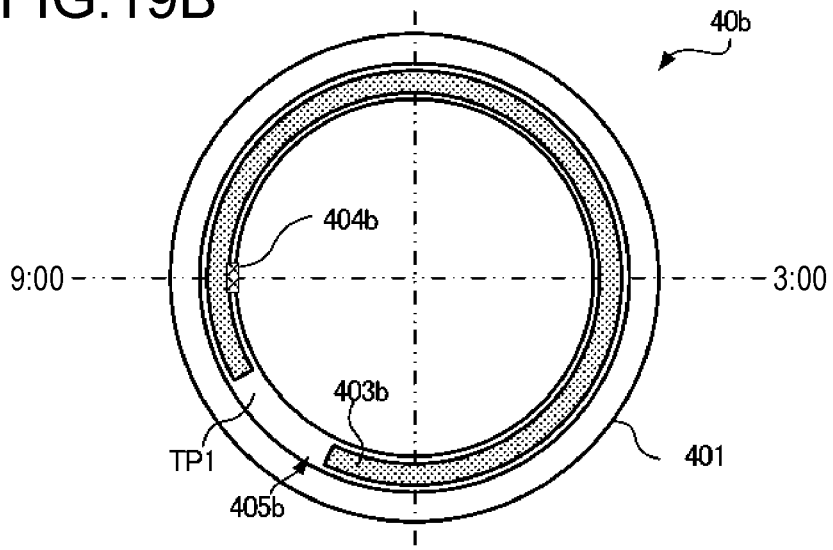

For example, the electronic timepiece 100 could have an antenna 40*b* such as shown in FIG. 19A and FIG. 19B. FIG. 19A is an oblique view of the antenna 40*b* according to variation 7, and FIG. 19B is a plan view of the antenna 40*b*.

This antenna 40*b* has an antenna element 403*b* that is fed a specific potential from the feed pin 44 through the feed part 404*b* formed on the top slope TP1 of the dielectric 401. The antenna 40*b* has an antenna length at which the antenna element 403*b* resonates to the satellite signal, and does not have a parasitic antenna element. The antenna element 403*b* shown in the figure is C-shaped with a notch 405*b*, but could be an endless loop (O-shaped) without a notch 405*b*.

Figure 20:
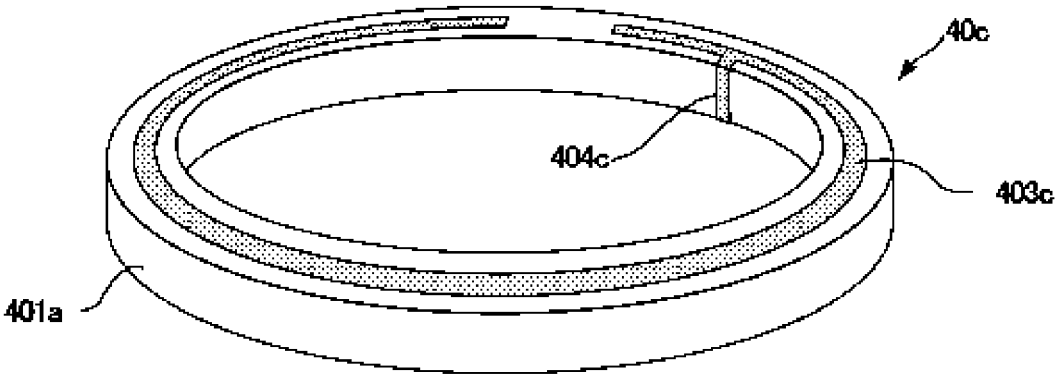
FIG. 20 is an oblique view of an antenna 40*c* according to a seventh variation of the invention.

The electronic timepiece 100 could also have an antenna 40*c* as shown in FIG. 20. FIG. 20 is an oblique view of an antenna 40*c* according to variation 7. This antenna 40*c* has an antenna element 403*c* that is fed a specific potential from the feed pin 44 through the feed part 404*c* formed on the top slope TP1 of a dielectric 401*a* that is rectangular in section. The antenna 40*c* has an antenna length at which the antenna element 403*c* resonates to the satellite signal, and does not have a parasitic antenna element.

Figure 21:
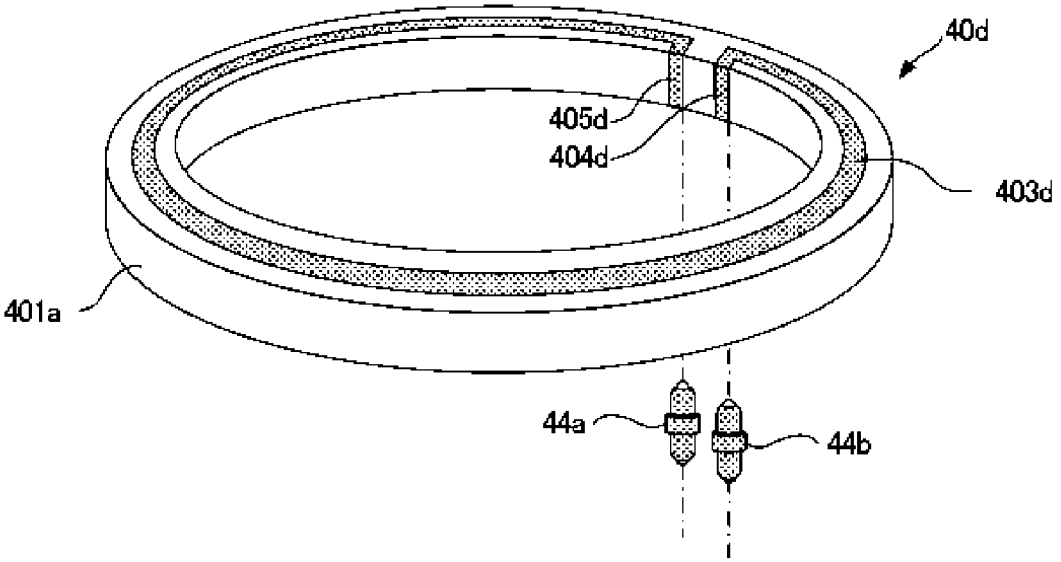
FIG. 21 is an oblique view of an antenna 40*d* according to a seventh variation of the invention.

In the foregoing embodiments and variations described above, the antenna 40 (or 40*a*, 40*b*, or 40*c*) has a feed part 404 (404*a*, 404*b*, 404*c*) at a single location, but could receive a balanced feed from feed parts at two locations. For example, the electronic timepiece 100 could have an antenna 40*d* as shown in FIG. 21. FIG. 21 is an oblique view of the antenna 40*d* according to variation 7.

This antenna 40*d* has an antenna element 403*d* formed on the top of the dielectric 401*a*, and two feed parts 404*d* and 405*d* electrically connected to the antenna element 403*d*. The antenna 40*d* receives a balanced feed through two feed pins 44*a* and 44*b* electrically connected to the two feed parts 404*d* and 405*d*. In this configuration, the electronic timepiece 100 preferably has a balun, which is a balanced-unbalanced conversion device. The balun converts the balanced signal output from the antenna 40*b* through feed pins 44*a* and 44*b* to an unbalanced signal, and then outputs to the GPS reception unit 26.

Variation 8

In the embodiments and variations described above, the antenna elements and feed parts are formed directly on the surface of the dielectric by a plating or silver paste printing process, but all or part of the antenna elements and feed parts could be embedded in the dielectric.

Figure 22:
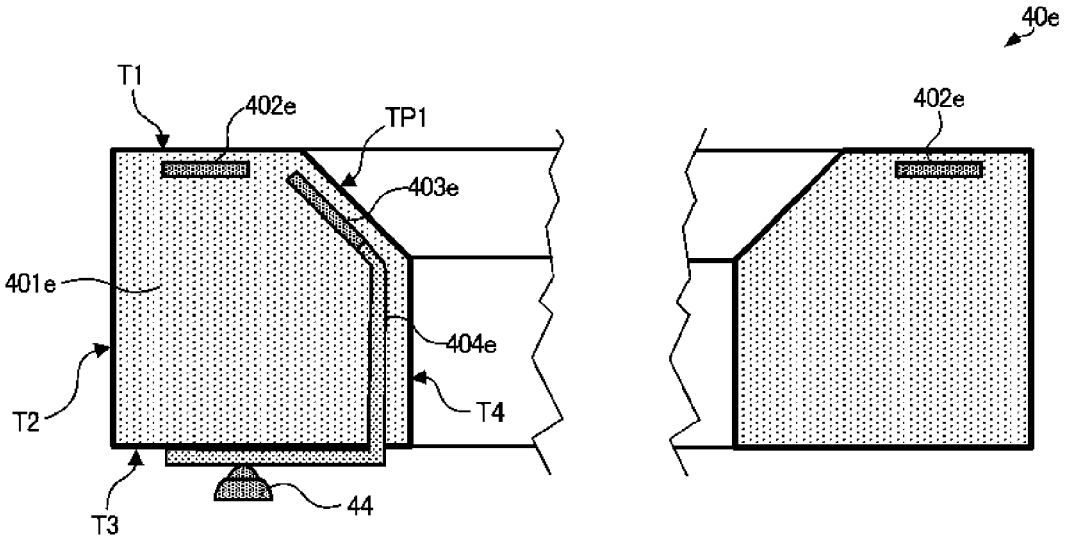
FIG. 22 is a section view of part of an antenna 40*e* according to an eighth variation of the invention.

For example, the electronic timepiece 100 could have an antenna 40*e* as shown in FIG. 22. FIG. 22 is a partial section view of an antenna 40*e* according to variation 8.

This antenna 40*e* has antenna element 402*e* and antenna element 403*e* embedded in a dielectric 401*e* that is pentagonal in section, and part of the feed part 404*e* is also embedded in the dielectric 401*e*. This configuration can be manufactured by insert molding. Insert molding enables manufacturing the antenna at a lower cost than when the antenna elements are formed by a plating or silver paste printing process.

Variation 9

In the embodiments and variations 1 to 7 described above, the antenna elements and feed parts are formed directly on the surface of the dielectric, but all or part of the antenna elements and feed parts could be affixed by flexible tape.

Figure 23:
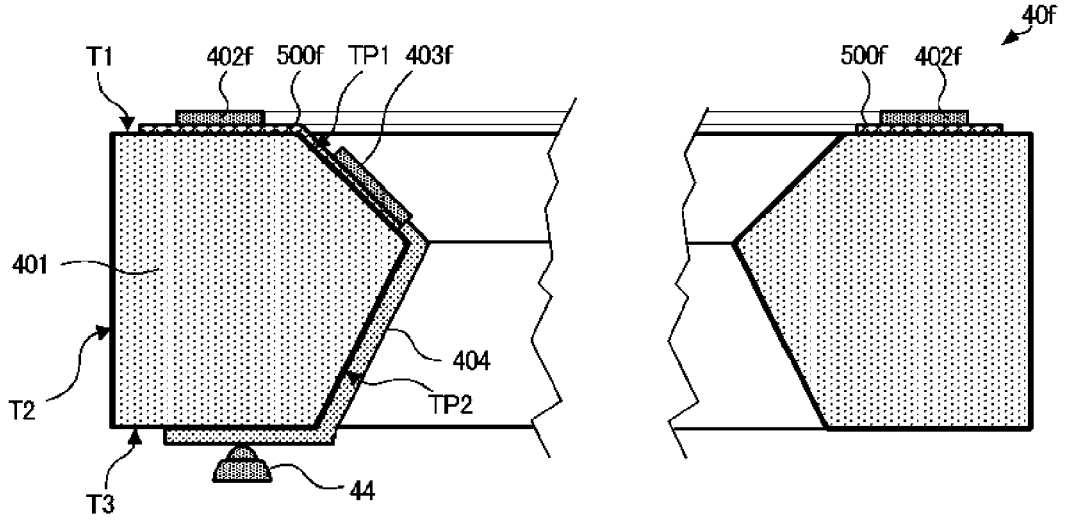
FIG. 23 is a section view of part of an antenna 40*f* according to a ninth variation of the invention.

For example, the electronic timepiece 100 could have an antenna 40*f* as shown in FIG. 23. FIG. 23 is a partial section view of an antenna 40*f* according to variation 9. This antenna 40*f* has antenna element 402*f* and antenna element 403*f* affixed with flexible tape 500*f*.

Figure 24:
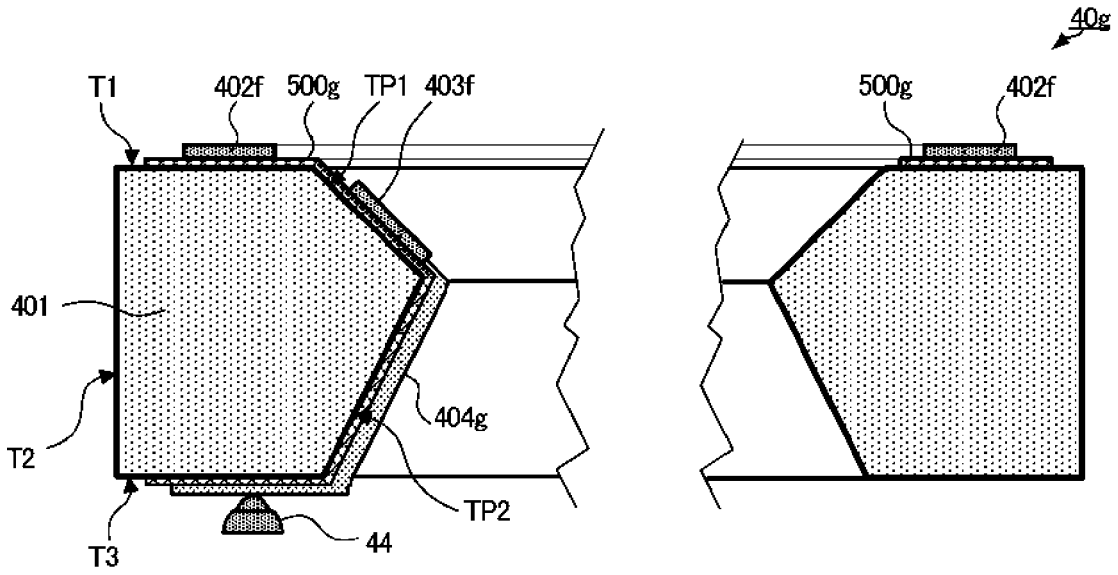
FIG. 24 is a section view of part of an antenna 40*g* according to a ninth variation of the invention.

The electronic timepiece 100 could also have an antenna 40*g* as shown in FIG. 24. FIG. 24 is a partial section view of another antenna 40*g* according to variation 9. This antenna 40*g* has antenna element 402*f*, antenna element 403*f*, and feed part 404*g* affixed with flexible tape 500*g*.

This configuration can be manufactured, for example, by forming the antenna elements and feed part on flexible tape, and affixing the flexible tape to the surface of the base. This manufacturing method enables manufacturing the antenna at a lower cost than when the antenna elements are formed by a plating or silver paste printing process.

Variation 10

In the embodiments and variations described above, the antenna is round when seen in plan view as shown in FIG. 5B, but could be a shape other than round.

Figure 25:
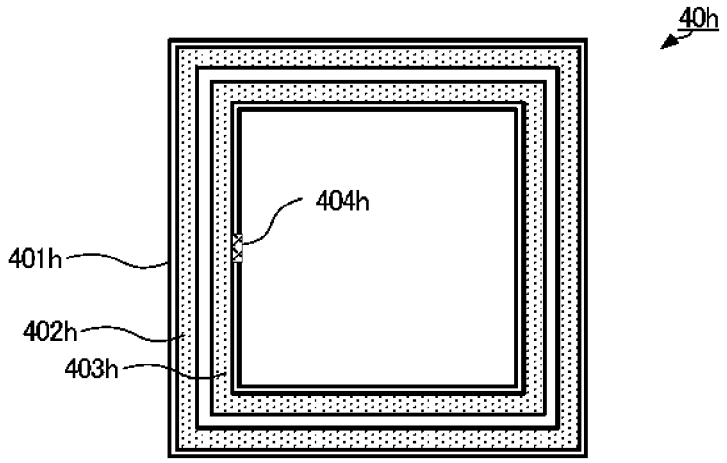
FIG. 25 is a plan view of an antenna 40*h* according to a tenth variation of the invention.

For example, the electronic timepiece 100 could have an antenna 40*h* as shown in FIG. 25. FIG. 25 is a plan view of a antenna 40*h* according to variation 10. This antenna 40*h* has antenna element 402*h* and antenna element 403*h* formed on a dielectric 401*h* that is square with an open center in plan view.

Variation 11

In the embodiments and variations described above, the electronic timepiece 100 has a ground plane 90, but a configuration not having is ground plane 90 is also conceivable. In this implementation the back cover 85 and body 81 function as a ground plane. Stable reception performance can therefore be maintained in the antenna 40 because a constant potential difference can be maintained between the antenna 40 and the ground plane (back cover 85 and body 81), and a constant resonance frequency can be maintained between the antenna 40 and the ground plane.

Variation 12

In the embodiments and variations described above, the time display unit includes a dial 11, center pivot 12, hands 13, subdial 14, indicator 15, and date display unit 19, but the invention is not so limited, and the time display unit could have only the center pivot 12 and hands 13.

When the time display unit does not include the subdial 14, indicator 15, and date display unit 19, the drive mechanism 30 can be rendered using only the stepper motors M1 and M2 that drive the center pivot 12 in the group of plural stepper motors M1 to M5, and the stepper motors M3 to M5 that drive the pivot 141, pivot 151, and date display unit 19 are not required. The magnetic screens S1 to S3 are also disposed in this embodiment to an area covering all or part of stepper motors M1 and M2.

Variation 13

In the embodiments and variations described above, the time display unit includes a dial 11, center pivot 12, and hands 13 (or additionally the subdial 14, indicator 15, and date display unit 19), but the invention is not so limited, and the time display unit could also have an LCD panel.

In the embodiments and variations described above, the time display unit includes a dial 11, center pivot 12, and hands 13, but the invention is not so limited, and the time display unit could have an LCD panel instead of the dial 11, center pivot 12, and hands 13. More specifically, the electronic timepiece 100 could be a digital electronic timepiece.

Variation 14

In the embodiments and variations described above, the storage battery 27 is a cylindrical battery, but the invention is not so limited. The storage battery 27 could have a square or other angular column shape, for example.

The center B of the storage battery 27 could also be the geometrical center of gravity of the storage battery 27 in plan view.

Variation 15

In the embodiments and variations described above, the feed pin 44 is disposed above the circuit board 25, but the invention is not so limited, and a configuration in which part of the feed pin 44 is disposed below the circuit board 25 is also conceivable.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosures of Japanese Patent Application Nos. 2012-209023, filed Sep. 24, 2012; 2012-209026, filed Sep. 24, 2012 and 2012-209027, filed Sep. 24, 2012 are expressly incorporated by reference herein.

What is claimed is:

1. An electronic timepiece with internal antenna, comprising:

a case;

an annular antenna housed in the case;

a time display unit that can display time and is disposed adjacent to the antenna and within a space whose outer limits are defined by an inner surface of the antenna, wherein the time display unit includes a dial;

a drive unit that is housed in the case and drives the time display unit; and a magnetic screen that is disposed superimposed with part or all of the drive unit in plan view;

wherein all of the antenna is not superimposed with the magnetic screen in plan view, the antenna has a first slope that is on an inside circumference of the antenna and increases in distance from a back cover of the case with proximity to a center of the antenna, the antenna has a second slope that is different from the first slope and meets the first slope at a point between a top surface and a bottom surface of the antenna, the dial is superimposed with at least part of the first slope of the antenna in plan view, and the dial and at least a part of the antenna are coplanar.

2. An electronic timepiece with internal antenna, comprising:

a case;

an annular antenna housed in the case;

a time display unit having a dial and hands that can display time directly, said dial being disposed directly adjacent to an inner face of the antenna without any parts between the dial and the antenna and within a space whose outer limits are defined by an inner surface of the antenna;

a main plate housed in the case;

a drive unit that is housed in the case on the opposite side of the main plate as the antenna, and drives the hands of the time display unit;

a first magnetic screen that is disposed between the drive unit and the main plate, and superimposed with part or all of the drive unit in plan view;

a receiver that processes a radio wave received by the annular antenna;

a circuit board on which the receiver is disposed; and a second magnetic screen that is disposed between the drive unit and the circuit board such that the second magnetic screen shields against noise from the circuit board and the receiver, wherein the antenna is not superimposed with the first magnetic screen in plan view, and wherein a face of a circumferential side wall of the dial is directly adjacent to the antenna without the dial contacting the antenna such that there is a gap between the circumferential side wall of the dial and the antenna.

3. The electronic timepiece with internal antenna described in claim 2, further comprising:

wherein the second magnetic screen is disposed on the opposite side of the main plate as the drive unit, and superimposed with part or all of the drive unit in plan view;

wherein the antenna is not superimposed with the second magnetic screen in plan view.

4. The electronic timepiece with internal antenna described in claim 2, further comprising:

a crystal that covers one of two openings in the case, and protects the time display unit; and wherein the case includes a back cover that covers the other of the two case openings;

wherein the time display unit includes a dial disposed between the crystal and the main plate, and a distance between the back cover and the dial is greater than a distance between the back cover and the antenna.

5. The electronic timepiece with internal antenna described in claim 4, further comprising:

a ground for the antenna between the antenna and the main plate;

wherein the case has a body that is made of a conductive material and is electrically connected to the ground; and the back cover is made of a conductive material and is electrically connected to the case.

6. An electronic timepiece with internal antenna, comprising:

a case;

an annular antenna housed in the case;

a time display unit that is disposed adjacent the antenna and within a space whose outer limits are defined by an inner surface of the antenna, and includes a dial and a hand that can rotate on a center pivot;

a drive unit that is housed in the case and drives the time display unit;

a battery compartment that holds a storage battery that feeds the antenna;

a receiver that processes a radio wave received by the annular antenna;

a circuit board on which the receiver is disposed; and a magnetic screen disposed between the drive unit and the circuit board such that the magnetic screen shields the drive unit against noise from the circuit board and the receiver, wherein the antenna is not superimposed with the storage battery held in the battery compartment when seen from a direction perpendicular to the dial, wherein a face of a circumferential side wall of the dial is directly adjacent to the antenna without the dial contacting the antenna such that there is a gap between the circumferential side wall of the dial and the antenna.

7. The electronic timepiece with internal antenna described in claim 6, further comprising:

a feed pin that electrically connects the circuit board and a feed part of the antenna; and an operating unit including a crown of which at least part is on the outside of the case, and a stem that transfers movement of the crown to the drive unit;

wherein the feed pin is not superimposed with the operating unit when seen from the direction perpendicular to the dial, and the circuit board that is housed in the case and has a control unit that controls operation of the drive unit.

8. The electronic timepiece with internal antenna described in claim 7, wherein:

the battery compartment is disposed on the opposite side of the circuit board as the feed pin.

9. The electronic timepiece with internal antenna described in claim 7, wherein:

the stem is disposed in the direction of 3:00 on the dial from the center pivot, and the feed pin is disposed from 6:00 to 12:00 on the dial from the center pivot, when seen from the direction perpendicular to the dial.

10. The electronic timepiece with internal antenna described in claim 9, wherein:

the operating unit includes a pusher of which at least part is on the outside of the case, and a button stem that transfers movement of the pusher to the drive unit or the control unit; and the button stem is disposed from 1:00 to 5:00 on the dial from the center pivot when seen from the direction perpendicular to the dial.

11. The electronic timepiece with internal antenna described in claim 7, wherein:

the control unit is not superimposed with the battery compartment when seen from the direction perpendicular to the dial.

12. The electronic timepiece with internal antenna described in claim 7, wherein:

when seen from the direction perpendicular to the dial, the angle formed by a line segment connecting the pivot and the feed pin, and a line segment connecting the pivot and the center of the storage battery in the battery compartment is greater than or equal to 90 degrees and less than or equal to 180 degrees, and the storage battery in the battery compartment is not superimposed with the operating unit.

13. The electronic timepiece with internal antenna described in claim 7, wherein:

when seen from the direction perpendicular to the dial, the length of a line segment connecting the pivot and the feed pin is greater than or equal to the length of a line segment connecting the pivot and the center of the storage battery in the battery compartment, and the storage battery in the battery compartment is not superimposed with the operating unit.

14. The electronic timepiece with internal antenna described in claim 7, wherein:

when seen from the direction perpendicular to the dial, the feed pin is disposed in the direction of 9:00 on the dial from the center pivot, and the battery compartment is disposed to a position where the storage battery in the battery compartment is positioned in the direction of 6:00 or 12:00 on the dial from the center pivot.

15. An electronic timepiece with internal antenna, comprising:

a case;

an annular antenna housed in the case;

a time display unit that is disposed directly adjacent to an inner face of the antenna and within a space whose outer limits are defined by an inner surface of the antenna, and includes a dial and a hand that can rotate on a pivot;

a circuit board that is housed in the case;

a drive unit that drives the time display unit and is disposed between the circuit board and the dial when seen from a direction parallel to the dial;

a feed pin that electrically connects the circuit board and a feed part of the antenna;

a receiver that processes a radio wave received by the annular antenna, the receiver being disposed on the circuit board;

a first magnetic screen disposed between the drive unit and the dial; and a second magnetic screen disposed between the drive unit and the circuit board such that the second magnetic screen shields the drive unit against noise from the circuit board and the receiver;

the feed pin is not superimposed with the first magnetic screen and second magnetic screen when seen from the direction perpendicular to the dial, a distance between the feed pin and the first magnetic screen is greater than a distance between the feed pin and the second magnetic screen when seen from the direction perpendicular to the dial, and wherein a face of a circumferential side wall of the dial is directly adjacent to the antenna without the dial contacting the antenna and without any parts between the circumferential side wall of the dial and the antenna such that there is a gap between the circumferential side wall of the dial and the antenna.

16. The electronic timepiece with internal antenna described in claim 15, wherein:

the distance between the feed pin and the first magnetic screen when seen from the direction perpendicular to the dial, and the distance between the feed pin and the second magnetic screen when seen from the direction perpendicular to the dial, are longer than the length of the feed pin.

17. The electronic timepiece with internal antenna described in claim 15, further comprising:

a battery compartment that holds a storage battery that feeds the antenna;

wherein a distance between the storage battery in the battery compartment and the feed pin when seen from the direction perpendicular to the dial is greater than the length of the feed pin.

18. The electronic timepiece with internal antenna described in claim 17, wherein:

the distance between the feed pin and the first magnetic screen is greater than the distance between the feed pin and the storage battery in the battery compartment when seen from the direction perpendicular to the dial.

19. The electronic timepiece with internal antenna described in claim 17, further comprising:

an operating unit including a crown of which at least part is on the outside of the case, and a stem that transfers movement of the crown to the drive unit;

wherein the stem is disposed in the direction of 3:00 on the dial from the center pivot and the feed pin is disposed between 6:00 and 12:00 on the dial from the center pivot when seen from the direction perpendicular to the dial.

* * * * *